US007865110B2

(12) United States Patent
Yamazaki

(10) Patent No.: US 7,865,110 B2
(45) Date of Patent: Jan. 4, 2011

(54) COVER BODY FOR IMAGE FORMING APPARATUS

(75) Inventor: Shigeki Yamazaki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 1061 days.

(21) Appl. No.: 11/604,782

(22) Filed: Nov. 28, 2006

(65) Prior Publication Data

US 2007/0253728 A1 Nov. 1, 2007

(30) Foreign Application Priority Data

Apr. 27, 2006 (JP) ..... 2006-123798

(51) Int. Cl.
*G03G 15/00* (2006.01)

(52) U.S. Cl. ..... 399/110; 399/124; 399/125

(58) Field of Classification Search ..... 399/110, 399/111, 124, 125
See application file for complete search history.

(56) References Cited

U.S. PATENT DOCUMENTS

| | | | | |
|---|---|---|---|---|
| 5,587,769 | A * | 12/1996 | Sawada et al. | 399/113 |
| 5,787,326 | A | 7/1998 | Ogawa et al. | |
| 5,930,564 | A | 7/1999 | Ookaji | |
| 7,136,609 | B2 * | 11/2006 | Askren et al. | 399/110 |
| 2004/0208670 | A1 * | 10/2004 | Abe | 399/110 |
| 2005/0036804 | A1 * | 2/2005 | Yokoi | 399/124 |
| 2005/0163533 | A1 * | 7/2005 | Hashimoto et al. | 399/124 |
| 2006/0083546 | A1 * | 4/2006 | Lee | 399/124 |
| 2006/0104661 | A1 * | 5/2006 | Nakanishi | 399/110 |
| 2006/0291897 | A1 * | 12/2006 | Ozawa | 399/110 |
| 2006/0291898 | A1 * | 12/2006 | Ozawa et al. | 399/110 |
| 2006/0291901 | A1 * | 12/2006 | Hiroe et al. | 399/121 |
| 2007/0230996 | A1 * | 10/2007 | Saito et al. | 399/110 |

FOREIGN PATENT DOCUMENTS

| | | | |
|---|---|---|---|
| JP | 9-305036 | A | 11/1997 |
| JP | 2003-330239 | A | 11/2003 |
| JP | 2004-272289 | A | 9/2004 |

* cited by examiner

*Primary Examiner*—David M Gray
*Assistant Examiner*—G. M. Hyder
(74) *Attorney, Agent, or Firm*—Sughrue Mion, PLLC

(57) ABSTRACT

An image forming apparatus including an image holding member, an image forming section that forms an image on the image holding member, a main frame that houses at least the image holding member and the image forming section, a cover body that is mounted to the main frame so as to be able to tilt down and includes a side cover for opening and closing a side surface of the main frame and a top cover for opening and closing a top surface of the main frame; and a unit that is mounted to and dismounted from the side cover by moving in a vertical direction between the top cover and the main frame in a state where the cover body is tilted down, is provided.

15 Claims, 25 Drawing Sheets

COVER BODY FOR IMAGE FORMING APPARATUS

TECHNICAL FIELD

The present invention relates to an image forming apparatus having a cover body mounted to a main frame and able to tilt down, and a unit removable from the cover body.

RELATED ART

An image forming apparatus that transfers and fixes a toner image formed on a photoreceptor (image holding member) or an intermediate transfer belt to a recording paper (recording medium) and thereby forms an image is conventionally known. Such an image forming apparatus includes an apparatus in which a unit such as a double-sided conveyance unit, which turns a recording paper having an image formed thereon upside down and conveys back the recording paper toward a main frame, or a conveyance unit, which conveys a recording medium with the recording medium opposing to a photoreceptor, is arranged on a cover body for opening or closing the main frame. This unit is fixed to the cover body or is removably mounted to the cover body by a sliding operation.

In the image forming apparatus of the above described conventional art, a fixing unit is arranged above the photoreceptor. A front-tilting type cover body for opening and closing the front (side) face of the main frame is arranged below the fixing unit. Thus, for maintenance or replacing of the fixing unit, not only the cover body for opening and closing the front face of the main frame but also the cover body for opening and closing the fixing unit needs to be provided. For this reason, cost is increased by an increase in the number of parts.

In order to address the above fact, it is proposed to forming a cover body for opening and closing the front face of the main frame and a cover body for opening and closing the fixing unit integrally. However, in this case, because the top surface of the cover body rises in a path for removing the unit, the unit cannot be mounted to or dismounted from the cover body.

SUMMARY

An aspect of the present invention is an image forming apparatus including: an image holding member; an image forming section that forms an image on the image holding member; a main frame that houses at least the image holding member and the image forming section; a cover body that is mounted to the main frame so as to be able to tilt down and includes a side cover for opening and closing a side surface of the main frame and a top cover for opening and closing a top surface of the main frame; and a unit that is mounted to and dismounted from the side cover by moving in a vertical direction between the top cover and the main frame in a state where the cover body is tilted down.

BRIEF DESCRIPTION OF THE DRAWINGS

Exemplary embodiments of the present invention will be described in detail based on the following figures, wherein.

DETAILED DESCRIPTION

Figure 1:
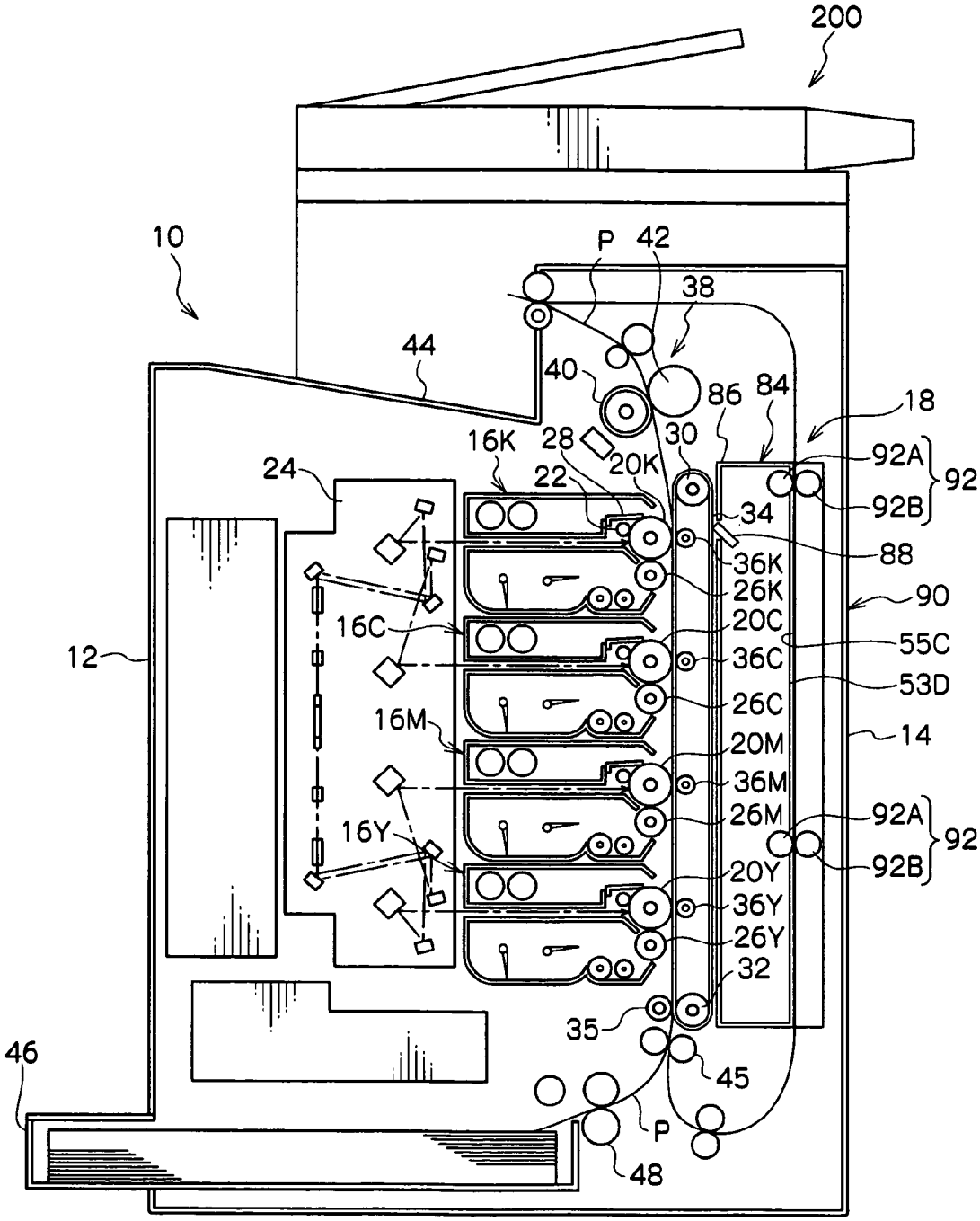
FIG. 1 is a schematic side view showing a construction of an image forming apparatus of a first exemplary embodiment.

Hereinafter, exemplary embodiments of the present invention will be described on the basis of examples shown in the drawings. Here, in the respective drawings, parts arranged for the respective colors of yellow (Y), magenta (M), cyan (C), and black (K) are denoted by reference signs accompanied by English characters "Y", "M", "C", or "K".

Figure 2:
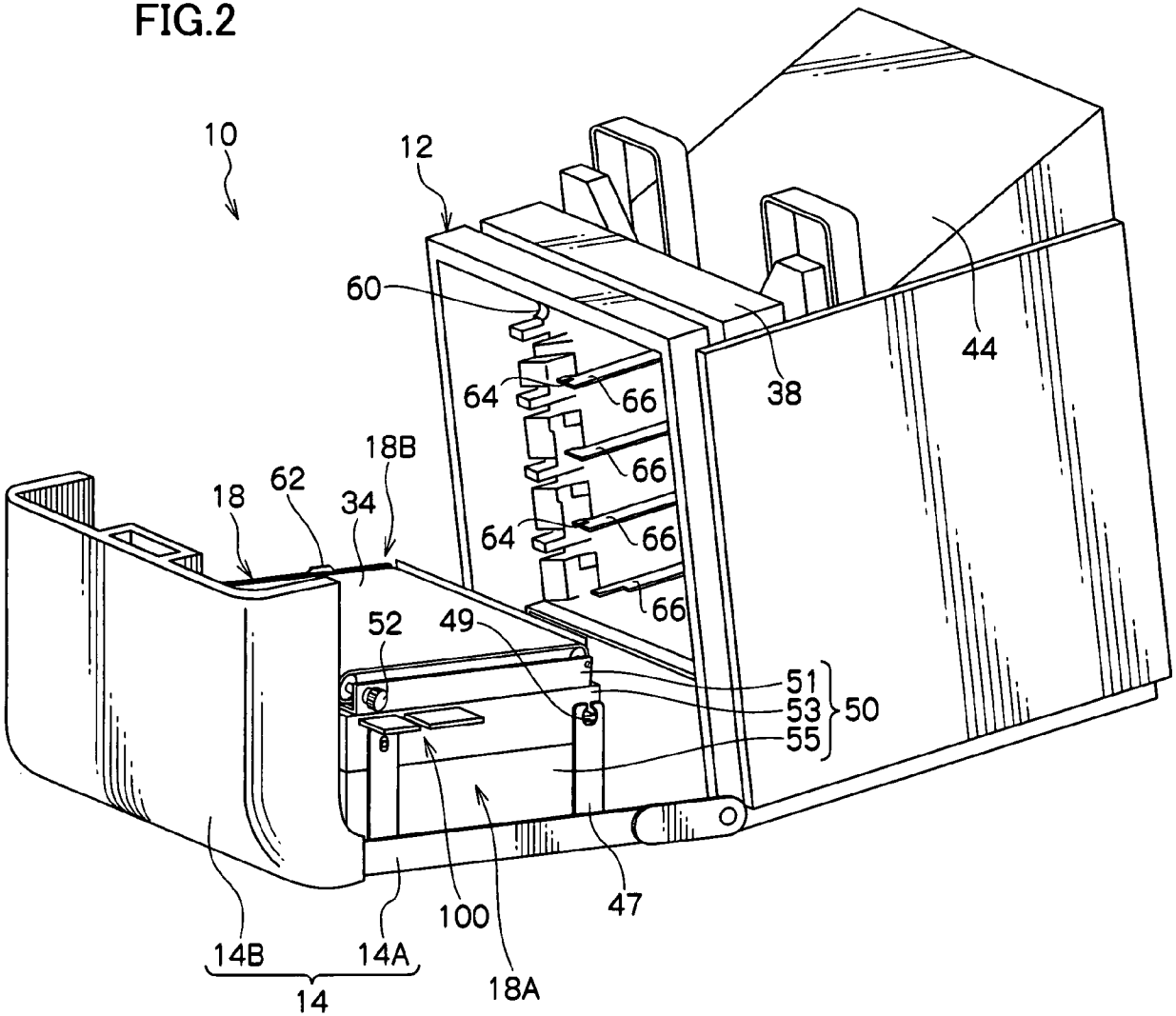
FIG. 2 is a perspective view showing the image forming apparatus in FIG. 1.

First, the outline of an image forming apparatus 10 according to the exemplary embodiments will be described. As shown in FIG. 1 and FIG. 2, the image forming apparatus 10 includes: a main frame 12 that houses image holding members (photoreceptors) 20 and developing units 16 in a detachable manner; and a cover body 14 that opens and closes the image holding members 20, the developing units 16 and a fixing unit 38 which is to be described later. The cover body 14 is detachably mounted with a conveyance unit 18 having a transfer belt 34 and the like that can adsorb and transfer a recording paper P. This cover body 14 is constructed of a front (side) cover 14A for opening and closing the front face of the apparatus and a top cover 14B for opening and closing the top of the apparatus and is formed in substantially L shape when viewed from a side and is fixed to the main frame 12 so as to be able to tilt down.

Each of the developing units 16 has a charging roller 22, an optical box 24, a developing roller 26, and a cleaning member 28. The charging roller 22 electrically charges the surface of the roller-shaped image holding member 20 uniformly. The optical box 24 irradiates an image light to the image holding member 20 on the basis of image data to form a latent image by a difference in electrostatic potential. The developing roller 26 transfers toner to the latent image selectively to visualize the latent image. The cleaning member 28 is put into sliding contact with the image holding member 20 having a toner image transferred thereto to clean the toner remaining on the image holding member 20.

The image holding member 20 has a photosensitive layer on the surface (peripheral surface) and has the surface (peripheral surface) electrically charged uniformly. Then, the surface (peripheral surface) is exposed to a laser light (image light) irradiated from the optical box 24, and an electrostatic latent image (image) is formed due to attenuation of the electric potential of the exposed portion of the surface. The charging roller 22 abuts against the image holding member 20 and voltage is applied therebetween. An electric discharge is developed in a small gap near the abutting portions, and thereby the surface (peripheral surface) of the image holding member 20 is electrically charged substantially uniformly.

The optical box 24 scans a flashing laser light to the surface (peripheral surface) of the image holding member 20 to form a latent image based on the image data on the surface (peripheral surface) of the image holding member 20. Here, the optical box 24 may be a unit such that a light emitting element such as LED is arranged and is made to flash lights on the basis of the image data or the like.

The developing rollers 26 are arranged close to and opposite to the image holding members 20, respectively. A developing bias voltage is applied between each of the developing rollers 26 and the image holding members. With this, a developing bias electric field is formed between each of the developing rollers 26 and the image holding members 20, and electrically charged toner is transferred to a portion exposed to the light on each of the image holding members 20 to form a visible image.

The conveyance unit 18 has a conveyance belt 34 stretched around at least a driving roller 30 and a driven roller 32. Plural transfer rollers (here, four rollers for the respective colors, which are to be described later) are arranged at predetermined intervals at predetermined positions between the driving roller 30 and the driven roller 32.

These transfer rollers 36 are opposed to the image holding members 20 across the conveyance belt 34, respectively, when the cover body 14 is closed (when the cover body 14 is rotated toward the main frame 12 to close the image holding members 20 and the like). When transfer electric fields are formed respectively between the transfer rollers 36 and image holding members 20, toner images (not-yet-fixed images) on the surfaces of the image holding members 20 are transferred to a recording paper P which is adsorbed and passed by the conveyance belt 34, respectively.

Moreover, the conveyance unit 18 has a charging roller 35 opposed to the driven roller 32 across a conveyance path of the recording paper P. This charging roller 35 nips the recording paper P and the conveyance belt 28 between itself and the driven roller 32 and electrically charges the recording paper P to make the recording paper P be adsorbed electrostatically on an adsorbing conveyance surface of the conveyance belt 28.

Further, the conveyance unit 18 has a cleaning unit 84 for cleaning the conveyance belt 34. This cleaning unit 84 has a recovery box 86, which is arranged between the conveyance belt 34 and the cover body 14, and a blade 88 which is supported by the recovery box 86 and its tip abuts on the conveyance belt 34. The cleaning unit 84 scrapes toner and paper powder adhering to the conveyance belt 34 away by the blade 88 and collects the toner and the paper powder scraped by the blade 88 in the recovery box 86.

Moreover, the conveyance unit 18 has a double-sided conveyance unit 90 that turns the recording paper P having an image printed on the surface upside down and conveys the recording paper P to the adsorbing conveyance surface of the conveyance belt 34. This double-sided conveyance unit 90 has plural pairs of conveyance rollers 92, which are arranged in a vertical direction between the conveyance belt 34 and the cover body 14, and guide plates 53D, 55C that guide the recording paper P conveyed by the pairs of conveyance rollers 92.

Here, the developing units 16 are arranged in the vertical direction, for example, in the order of yellow (Y), magenta (M), cyan (C), and black (K) from the bottom so as to perform full color printing. A fixing unit 38 is arranged at a position downstream side in the conveyance direction of the recording paper P than these developing units 16Y to 16K (and at an upper position in the main frame 12).

The fixing unit 38 has a heating roller 40 and a pressing roller 42 whose peripheral surfaces are opposed to each other and are put into press contact with each other (in a nipping state) by a predetermined pressure. The not-yet-fixed toner image which is transferred to the recording paper P is heated and pressed by the heating roller 40 and the pressing roller 42, thereby the toner image can be fixed to the recording paper P.

The recording paper P, which is heated and pressed and thereby the toner image is fixed thereon by the fixing unit 38 (heating roller 40 and pressing roller 42) is discharged to a paper discharge tray 44. After transferring of the toner images to the recording paper P is finished, the surfaces (peripheral surface) of the image holding members 20 are cleaned by the cleaning members 28 and prepared for the next developing processing.

A detachable paper feed cassette 46 is provided at a lower position of the main frame 12. This paper feed cassette 46 can be pulled out in a direction opposite to a direction in which the recording paper P is fed out to feed recording paper P as needed.

A pair of paper feed rollers 48 that feeds the recording paper P one by one from the paper feed cassette 46 are provided near the tip end of the paper feed cassette 46. The recording paper P fed by the pair of paper feed rollers 48 is fed out to the adsorbing conveyance surface of the conveyance belt 34 at a predetermined timing by a pair of registration rollers 45 and then is conveyed to positions where the toner images of the respective colors are transferred.

Figure 3:
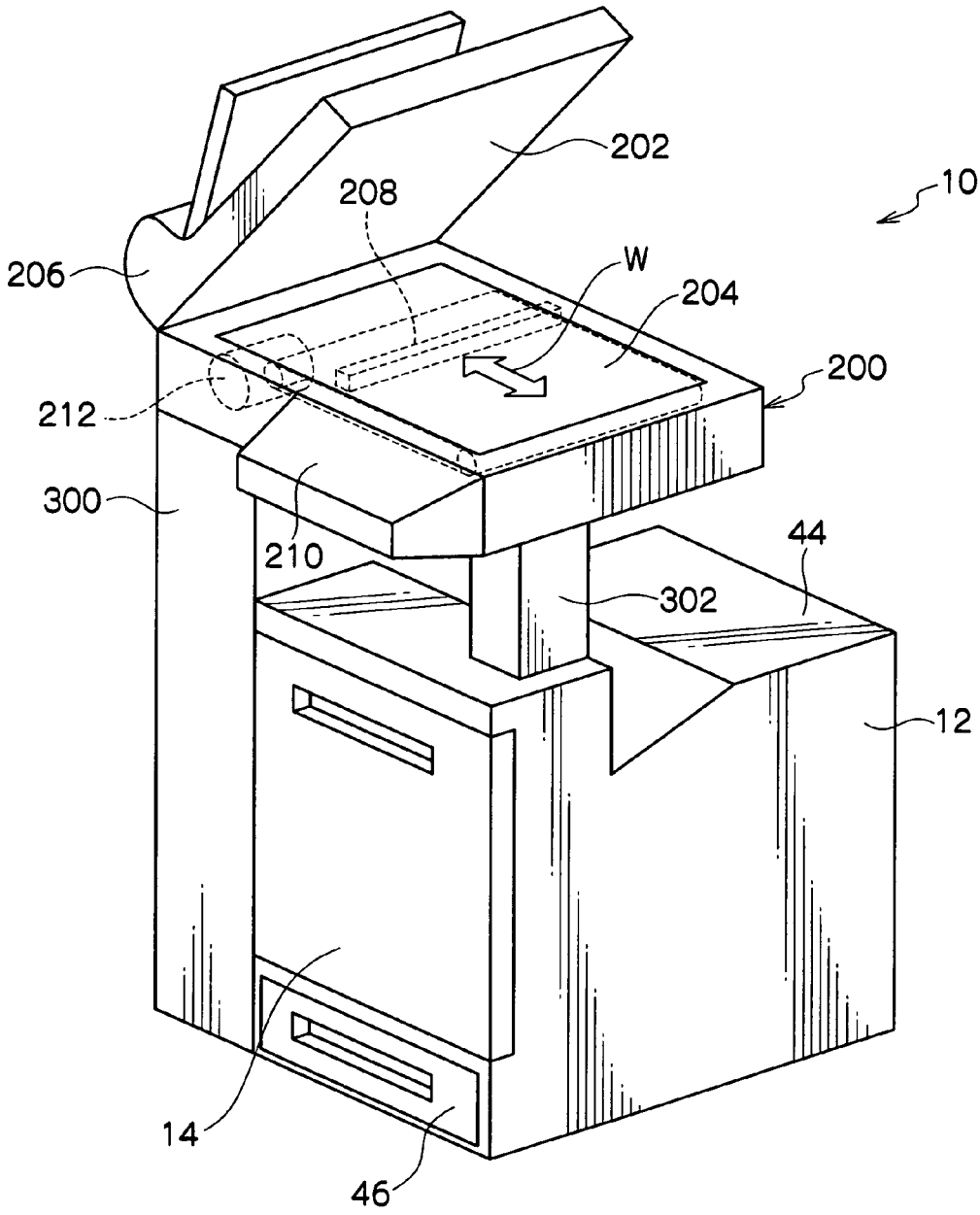
FIG. 3 is a perspective view showing the image forming apparatus in FIG. 1.

Moreover, an image reading device 200 is provided on the main frame 12. As shown in FIG. 3, the image reading device 200 is substantially rectangle shape when seen in a plan view and is fixed to a first support 300 and a second support 302 erected on the left and right corner portions of the main frame 12.

Moreover, the image reading device 200 includes: a pressing plate 202 rotatably mounted to the top of the image reading device 200; a transparent document table 204 which is made of a platen glass or the like, provided under the pressing plate 202, and on which a document is placed; an automatic document feed unit 206 mounted on the top of the pressing plate 202; a reading bar 208 provided below the document table 204 and for reading a document placed on the document table 204; and an operating unit 210 provided on the front side of the image reading device 200. The reading bar 208 is elongated from the front side to the back side of the image forming apparatus 100. The reading bar 208 scans in a direction shown by an arrow W by a scanning driving mechanism 212 and reads an image on the document placed on the document table 204. Operating keys are provided on the top surface of the operating unit 210 and the image reading device 200 starts or stops reading the document by the operating keys being operated.

Figure 4:
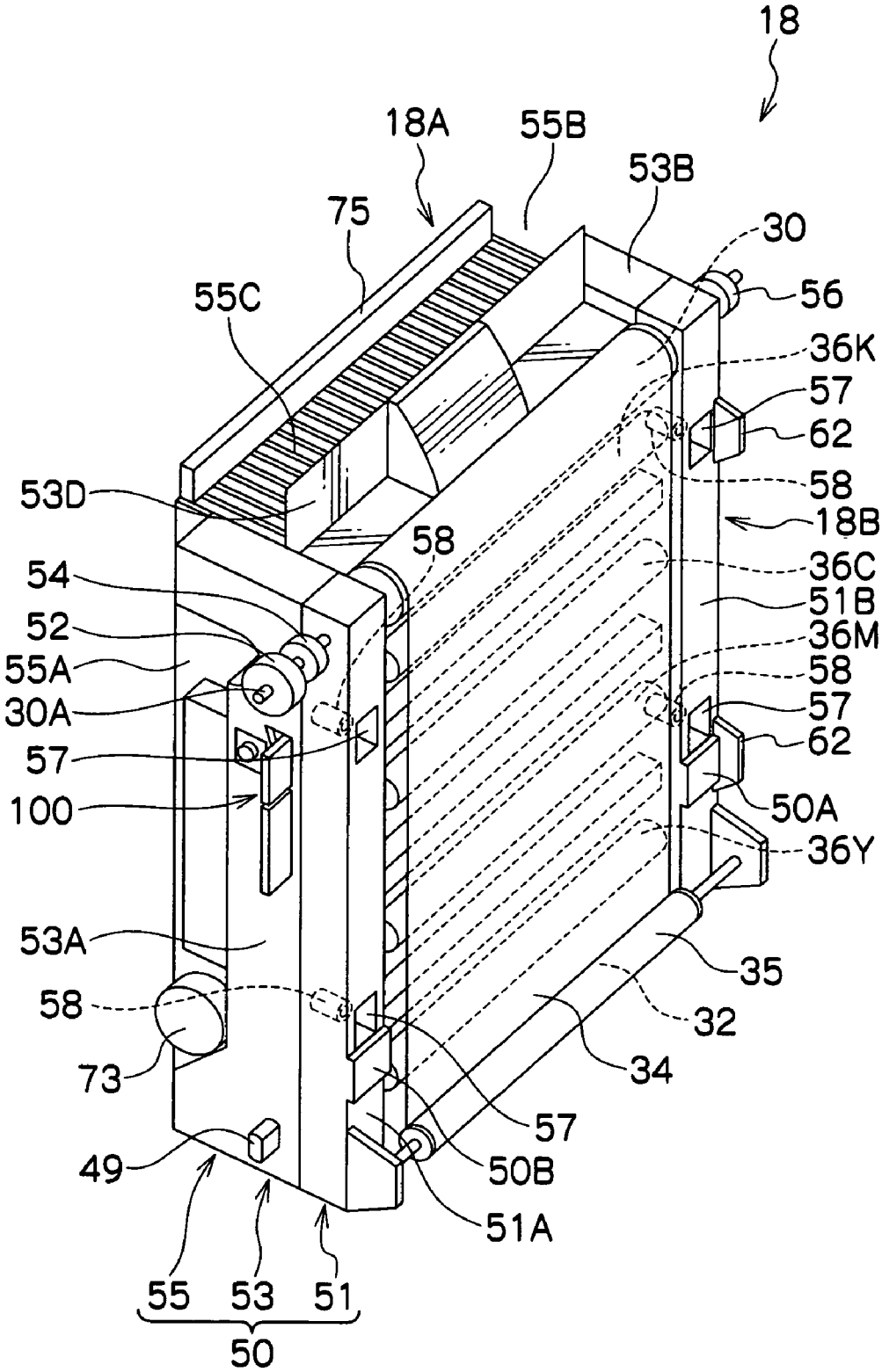
FIG. 4 is a perspective view showing a conveyance unit provided in the image forming apparatus in FIG. 1.
Figure 5:
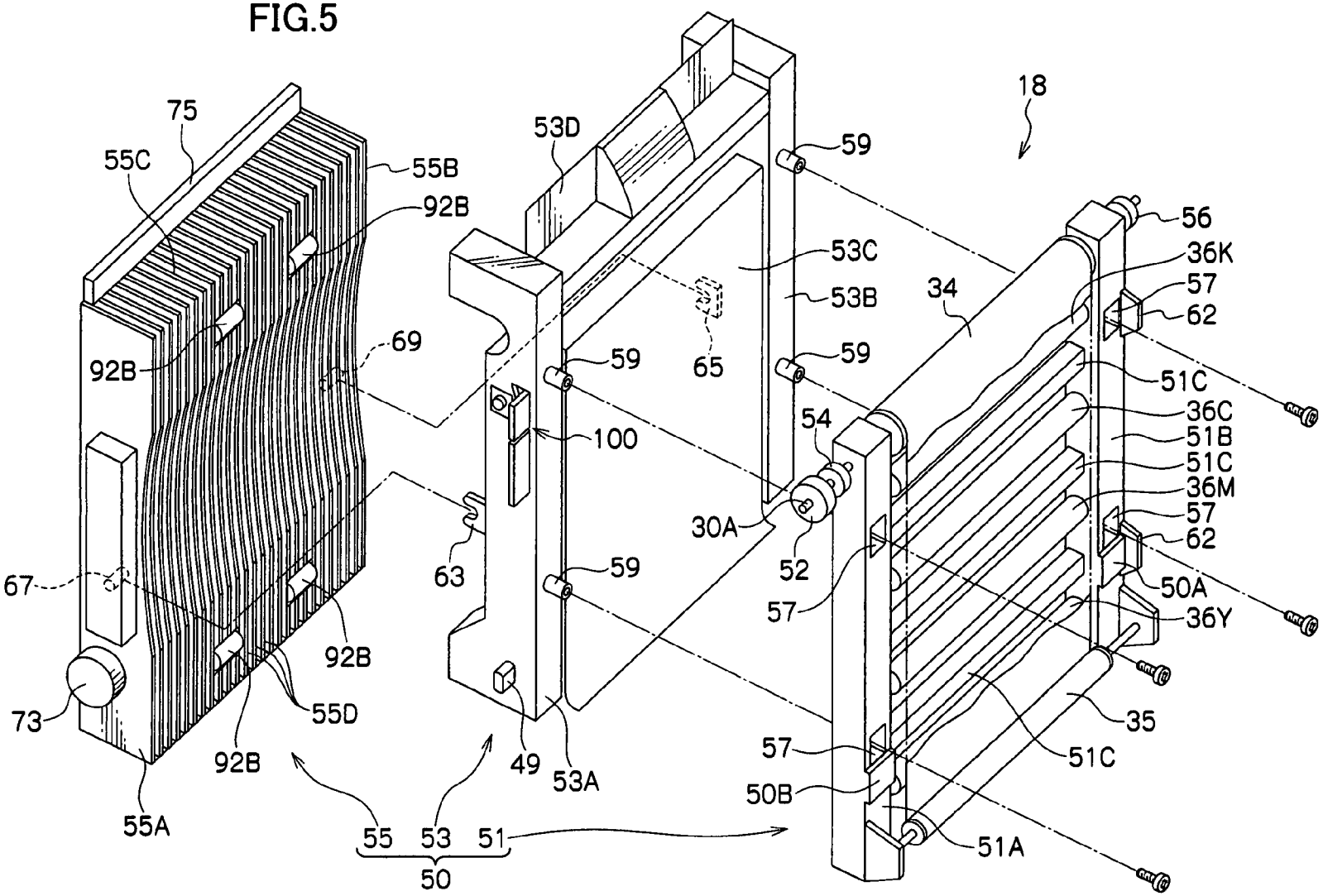
FIG. 5 is an exploded perspective view showing the conveyance unit in FIG. 4.
Figure 6:
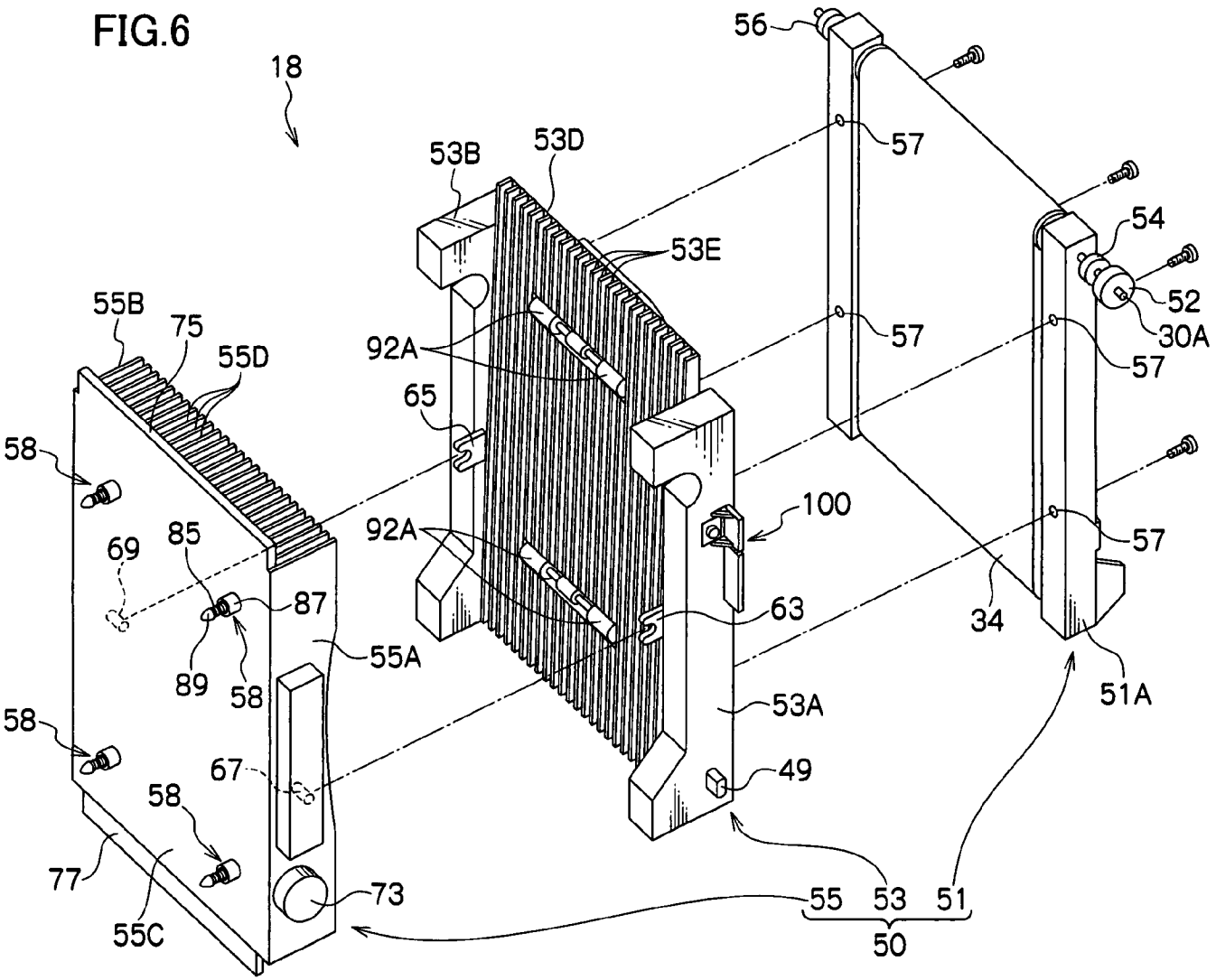
FIG. 6 is an exploded perspective view showing the conveyance unit in FIG. 4.

In the image forming apparatus 10 constructed in the manner described above, next, the conveyance unit 18 detachably mounted to the cover body 14 will be described in further detail. As shown in FIG. 4 to FIG. 6, the conveyance unit 18 has a case 50 formed in substantially rectangular box shape. The driving roller 30 has its shaft rotatably supported on one end portion (top end portion) of the case 50 and the driven roller 32 has its shaft rotatably supported on the other end portion (bottom end portion). The conveyance belt 34 capable of electrostatically adsorbing the recording paper is wound around and stretched around the driving roller 30 and the driven roller 32.

Transfer rollers 36Y to 36K are arranged at predetermined intervals for the respective colors on the inner surface side of the transfer belt 34 and between the driving roller 30 and the driven roller 32. The respective transfer rollers 36Y to 36K also have their shafts rotatably supported by the case 50. As shown in FIG. 1, when the cover body 14 is closed, the respective transfer rollers 36Y to 36K are put into press contact with the respective image holding members 20Y to 20K across the transfer belt 34 by a predetermined pressure and are rotated due to traveling of the transfer belt 34.

As shown in FIG. 4 to FIG. 6, a gear 52 for transmitting a rotational power to the driving roller 30 is fixed to one end of a rotary shaft 30A of the driving roller 30 which is projecting outside the case 50. An annular member 54 is fitted with a clearance on the rotary shaft 30A inside the gear 52 and outside the case 50. Similarly, an annular member 56 is fitted with a clearance on the other side of the rotary shaft 30A projecting outside the case 50.

Figure 7:
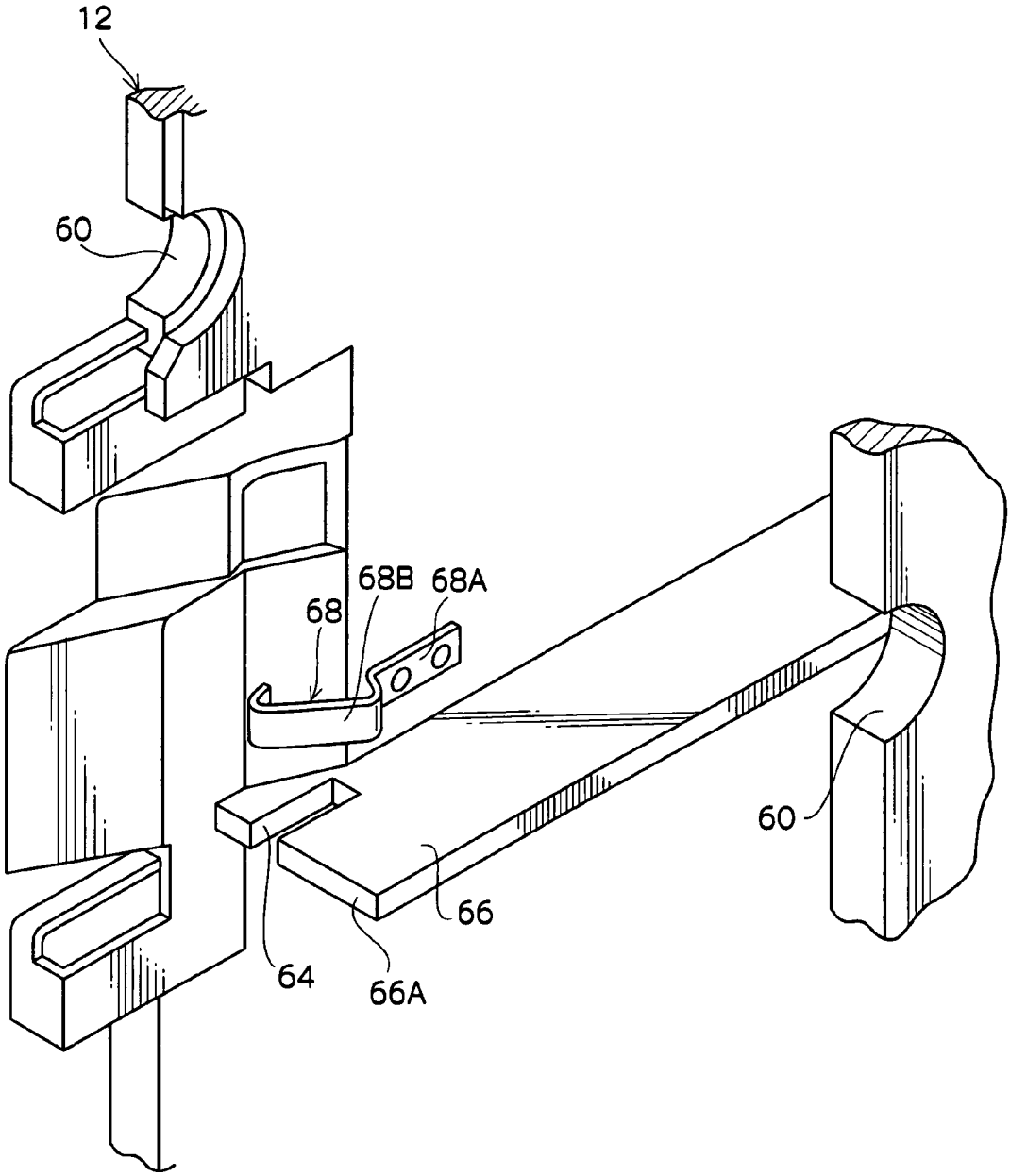
FIG. 7 is an enlarged partial perspective view of the image forming apparatus in FIG. 1.

In contrast, as shown in FIG. 2 and FIG. 7, a pair of left and right concave portions 60 (first regulating portions) having substantially U shape when viewed from the side and on which the respective annular members 54, 56 abut, are formed at predetermined positions in the upper side of the main frame 12. Further, as shown in FIG. 4 and FIG. 6, plural (four, as shown in the drawing) urging mechanisms 58 are provided on the outer surface side (the cover body 14 side) of the case 50. The urging mechanisms 58 press the transfer unit 18 toward the main frame 12 by a predetermined pressure when the cover body 14 is closed.

Figure 8:
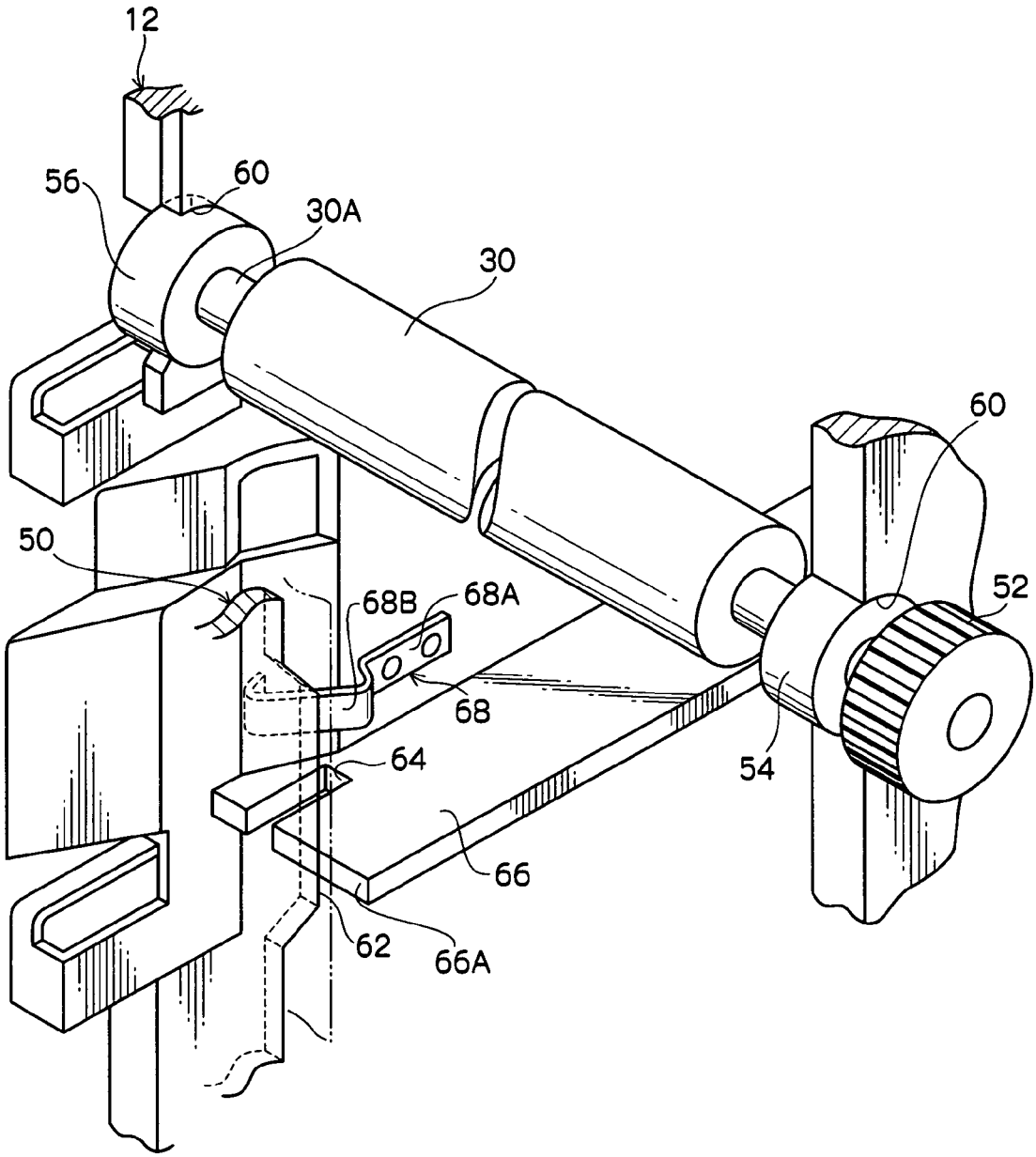
FIG. 8 is a perspective view showing the state of a main portion of the image forming apparatus in FIG. 1 when the cover body is closed.

Hence, as shown in FIG. 8, the respective annular members 54, 56 reliably abut on the concave portions 60 to regulate movement of the driving roller 30 in the radial direction thereof (a direction perpendicular to the axial direction of the driving roller 30). That is, the position of the transfer unit 18 with respect to the main frame 12, and the positions of the transfer rollers 36 (conveyance belt 34) with respect to the image holding members 20 can be regulated at a predetermined positions. Here, the shape of the concave portions 60 are not limited to substantially U shape shown in the drawing but may be formed in V shape, for example.

As shown in FIG. 4 and FIG. 5, the edge portion of the case 50 on a side where the annular member 56 is fitted (on the other end side where the gear 52 is not provided) is formed relatively thick in at least between the transfer roller 36Y and the transfer roller 36M, and between the transfer roller 36C and the transfer roller 36K. A plate-shaped projecting part 62 (engaging member) is fixed to an engaging surface 50A which is formed in the relative thick portion so as to project by a predetermined height in the radial direction of the driving roller 30 and the driven roller 32.

Here, to regulate the position of the conveyance unit 18 with respect to the main frame 12, the conveyance unit 18 may be regulated at its top and bottom end portions. Therefore, in this case, to regulate the position in the radial direction (the direction perpendicular to the axial direction) by the concave portion 60, at least one of the projections 62 is provided at a position as separate from the concave portion 60 as possible. Thus, as shown in the drawing, one of the projections 62 is provided between the transfer roller 36Y which is farthest from the driving roller 30 (concave portion 60) and the transfer roller 36M which is second farthest.

In contrast, slit portions 64 (second regulating portions) through which the projection 62 can be inserted with a clearance are formed, as shown in FIG. 7, in a support part 66 between the developing unit 16Y and the developing unit 16M and in a support part 66 between the developing unit 16M and the developing unit 16K, of support parts 66 (see FIG. 2) of the main frame 12 which supports the respective developing units 16Y to 16K from below both ends in the axial direction and can house them.

Figure 10A:
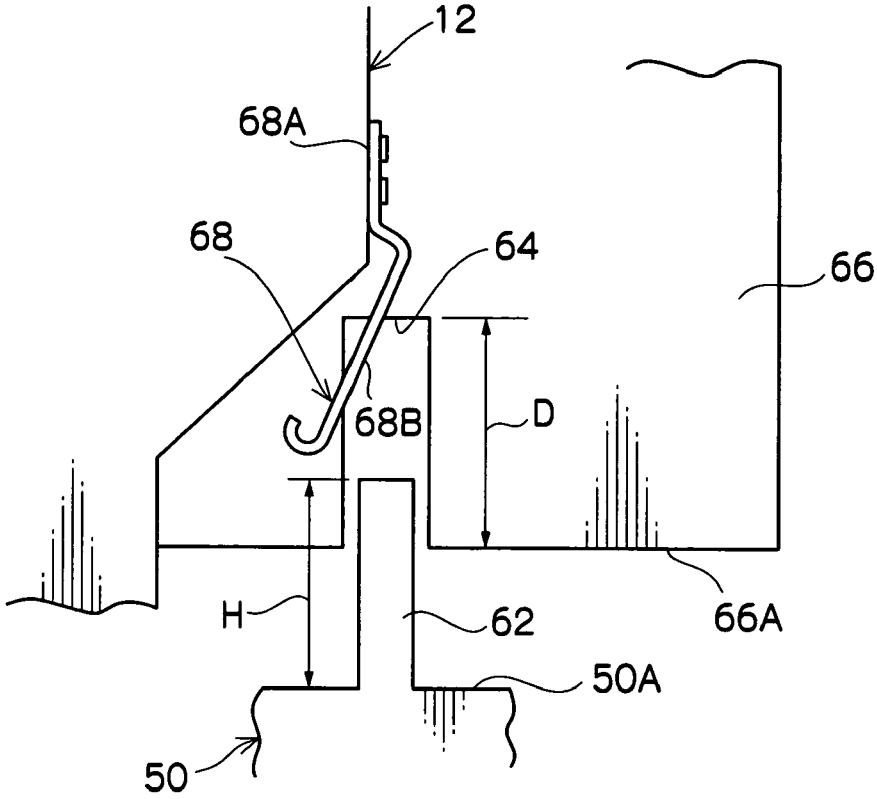
FIGS. 10A and 10B are plan views showing the state of a main portion of the image forming apparatus in FIG. 1 when the cover body is closed.
Figure 10B:
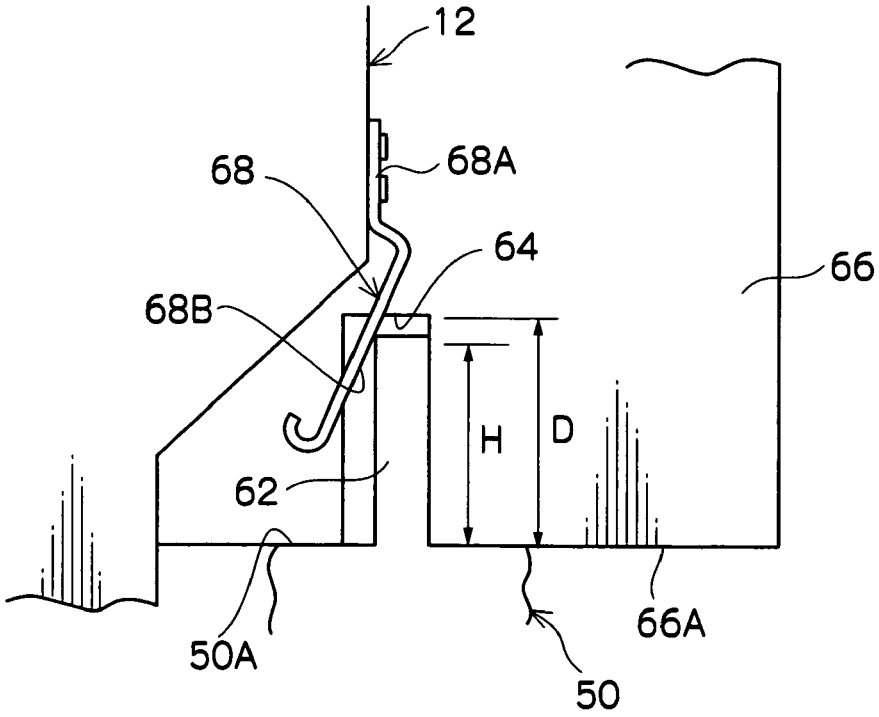

As shown in FIGS. 10A and 10B, the depth D of this slip portion 64 is made larger than projecting height H of the projecting portion 62 (D>H). Therefore, when the cover body 14 is closed, the tip surface 66A of the support part 66 having the slit portion 64 formed therein abuts against the engaging surface 50A in the portion formed relatively thick of the case 50 where the projecting part 62 is formed.

Figure 11:
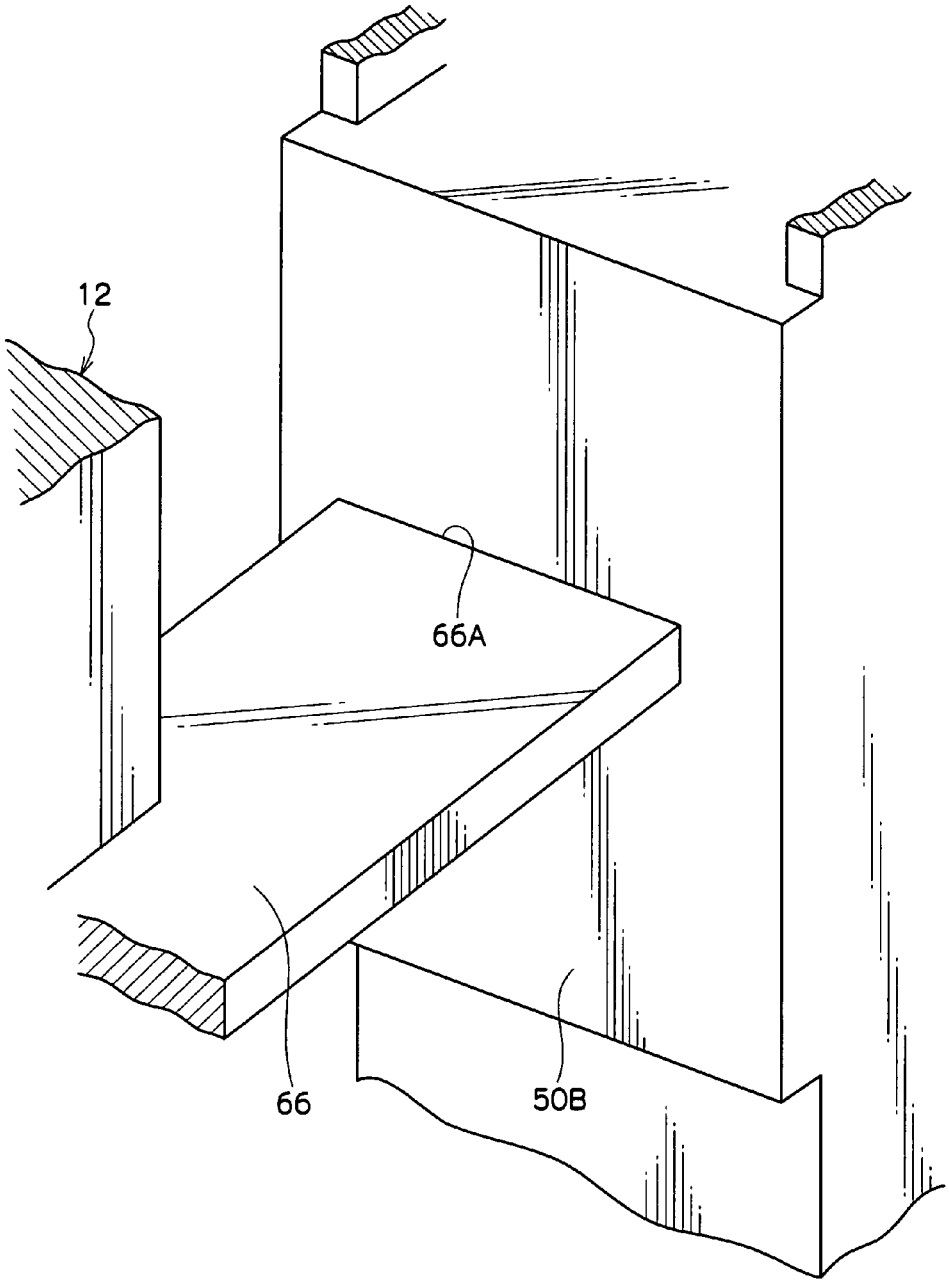
FIG. 11 is a perspective view showing the state of a main portion of the image forming apparatus in FIG. 1 when the cover body is closed.

As shown in FIG. 11, a portion at least between the transfer roller 36Y and the transfer roller 36M of the edge portion of the case 50 on the side where the annular member 54 is fixed is formed relatively thick. The tip surface 66A of the support part 66 abuts on an engaging surface 50B of the portion formed relatively thick.

With this construction, the movement in the radial direction (the direction perpendicular to the axial direction) of the driving roller 30 of the conveyance unit 18 is further regulated, whereby the position of the conveyance unit 18 with respect to the main frame 12, that is, the position of the transfer roller 36 (conveyance belt 34) with respect to the image holding member 20 is regulated at a predetermined position.

Figure 9:
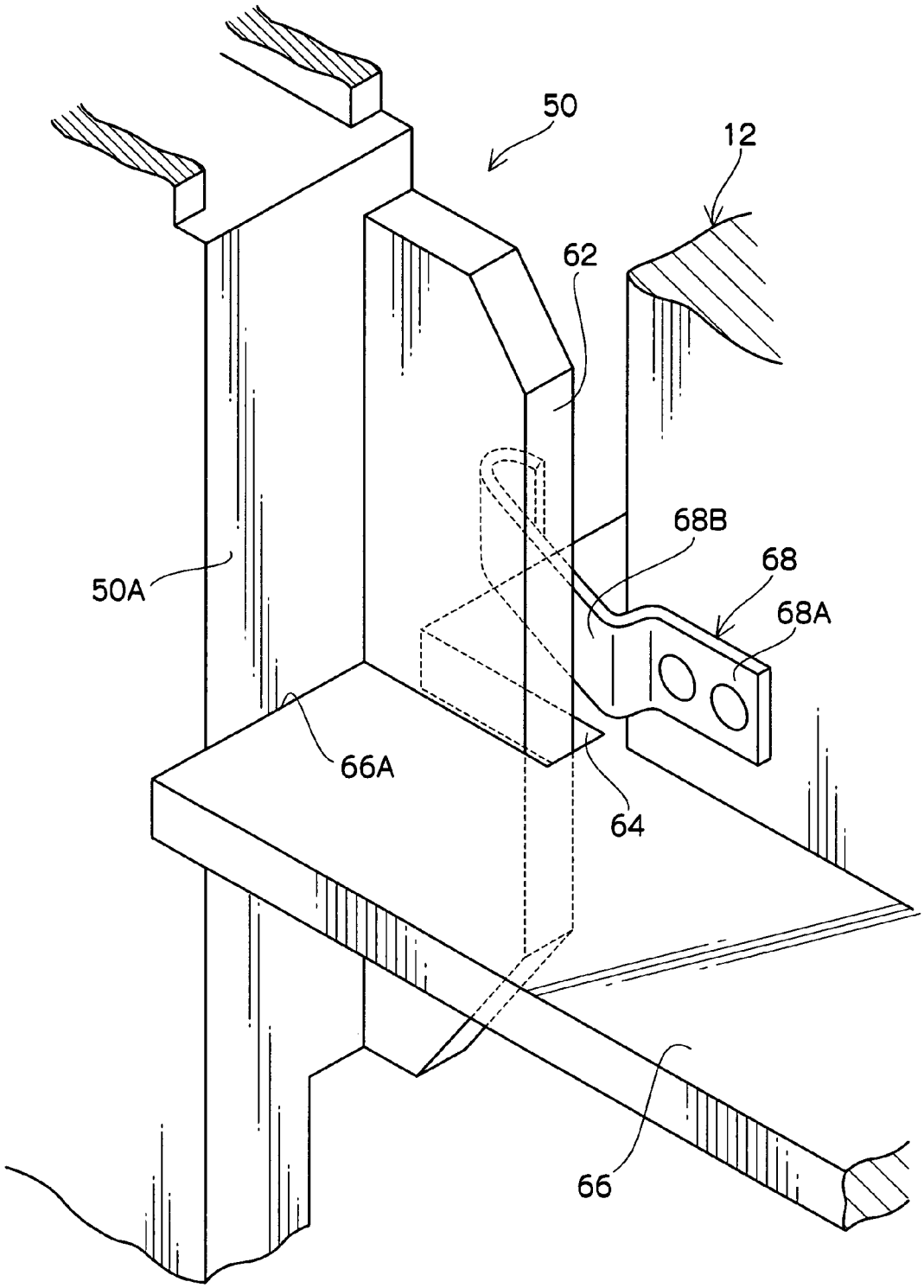
FIG. 9 is a perspective view showing the state of a main portion of the image forming apparatus in FIG. 1 when the cover body is closed.

Moreover, as shown in FIG. 7, a plate spring 68 is arranged above (or below) the support part 66 and its base portion 68A is fixed to the main frame 12. As shown in FIG. 8 to FIG. 10, when the projecting part 62 is inserted into the slit portion 64 so as to have clearance, the outside surface (or inside surface) of the projecting part 62 is pressed toward the axial direction of the driving roller 30 (the driven roller 32) by an acting portion 68B of the plate spring 68.

Thus the conveyance unit 18 is pressed toward one end side in the axial direction (or other end side in the direction of the width) of the driving roller 30 (driven roller 32) by a predetermined pressure. Therefore, the movement of the driving roller 30 (driven roller 32) of the conveyance unit 18 (conveyance belt 34) toward the axial direction thereof is regulated, and, even when a user presses the cover body 14 by mistake or something collides with the cover body 14 during printing, for example, the conveyance unit 18 (conveyance belt 34) provided in the cover body 14 will not displace.

Note that, a torsion spring (not shown) or the like may be used in place of the plate spring 68 shown in the drawing. Further, of course, a construction such that the same part as the projecting part 62 can be formed on the main frame 12 and the same portion as the slit portion 64 can be formed in the case 50, can produce the same effect as described above.

Figure 12:
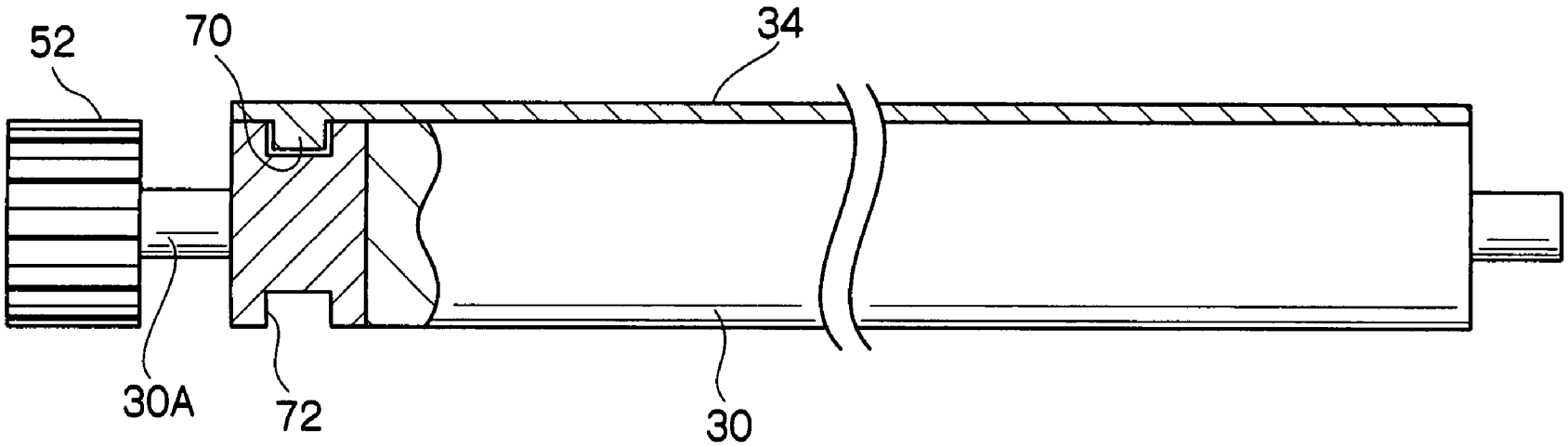
FIG. 12 is a plan view showing a portion of the conveyance unit in FIG. 4.

Moreover, as shown in FIG. 12 (the annular members 54, 56 are omitted in FIG. 12), a rib-shaped projection 70 is formed on the inner surface (rear surface) at one end side (side where the gear 52 is fixed) in the direction of the width of the conveyance belt 34 in a line along the direction in which the conveyance belt 34 travels. The rib-shaped projection 70 is engaged (inserted with clearance) in concave grooves 72 formed at one end side (side where the gear 52 is fixed) of the driving roller 30 and the driven roller 32. Hence, the conveyance belt 34 will not easily meander in the axial direction of the driving roller 30 and the driven roller 32.

Thus, when the conveyance belt 34 is stretched around the driving roller 30 and the driven roller 32, the rib-shaped projection 70 interferes the stretching of the conveyance belt 34. Hence, the conveyance belt 34 is wound around the respective rollers 30, 32 from a side where the concave groove 72 is formed. For this reason, the projection 62 is formed on the other end side where the concave groove 72 is not formed (side where the gear 52 is not fixed). With this, it is possible to improve the ease of assembly (winding and stretching) of the conveyance belt 34 with respect to the respective rollers 30, 32 (i.e., it is possible to assemble the conveyance belt 34 without interference from the projection 62).

As shown in FIG. 4 to FIG. 6, the conveyance unit 18 is constructed of a first unit 18A having driving roller 92B and the like, which will be described later, and a second unit 18B having the conveyance belt 34, the driving roller 30, the driven roller 32, the transfer rollers 36, the charging roller 35, and the like. Further, the case 50 is constructed of: a first case part 51 of a rectangular frame body for supporting the driving roller 30, driven roller 32, the transfer rollers 36, and the charging roller 35; a second case part 53, having a rectangular box shape, to which the first case part 51 is fastened by screws; and a third case part 55 which is a rectangular plate member divided from the second case part 53 at the surface at a side of the cover body 14 of the second case part 53.

The first case part 51 is constructed of: a pair of side plates 51A, 51B for supporting both end portions in the axial direction of the driving roller 30, the driven roller 32, the transfer rollers 36, and the charging roller 35 via axle bearings (not shown); and support plates 51C for supporting this pair of side plates 51A, 51B. The side plate 51A has the above-mentioned engaging surface 50B formed thereon and the side plate 51B has the above-mentioned engaging surface 50A, the projections 62, and 64 formed thereon. The support plates 51C are housed on the inner peripheral side of the conveyance belt 34. Further, each of the side plates 51A and 51B has two screw fastening parts 57 for fastening the first case part 51 to the second case part 53 by screws.

The second case part 53 is constructed of: a pair of side plates 53A, 53B each having two screw fastening parts 59 opposing to the screw fastening parts 57; and a plate 53C opposite to the support plates 51C of the first case part 51; and a guide plate 53D provided on the third case part 55 side of the plate 53C and having gently curved form.

The guide plate 53D has plural ribs 53E arranged in a direction perpendicular to a conveyance direction of the recording paper P by a pair of conveyance rollers 92 (hereinafter referred to as "reverse conveyance direction") and extended along the reverse conveyance direction. Moreover, driven rollers 92A are rotatably supported one on the upstream side and one on the downstream side in the reverse conveyance direction of the guide plate 53D.

Figure 13A:
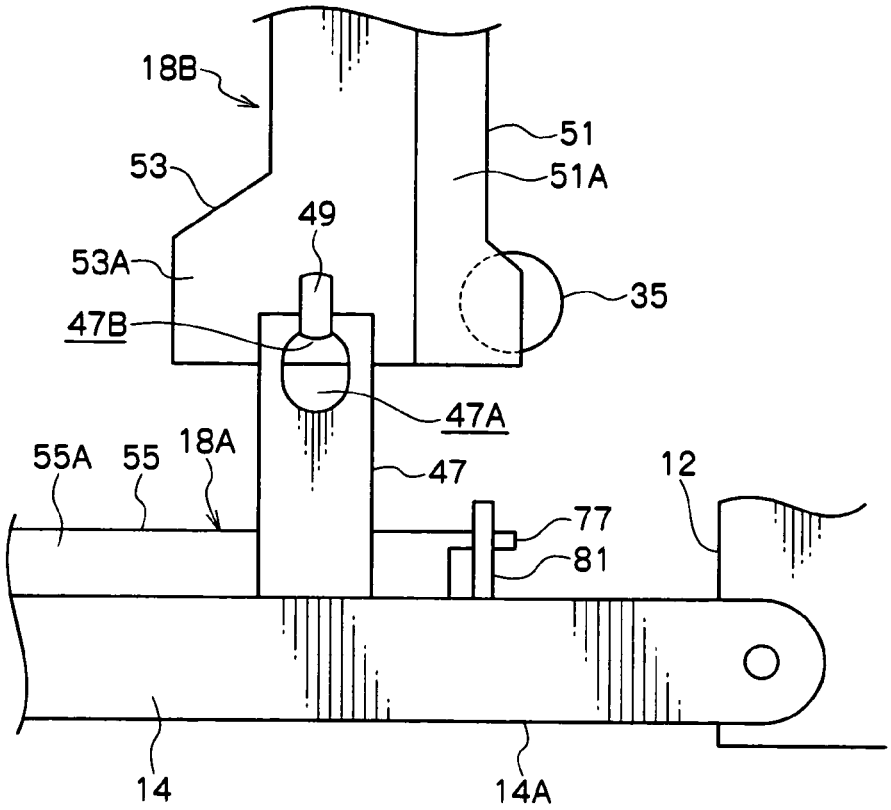
FIGS. 13A and 13B are side views showing an operation of mounting the conveyance unit in FIG. 4 to the cover body.
Figure 13B:
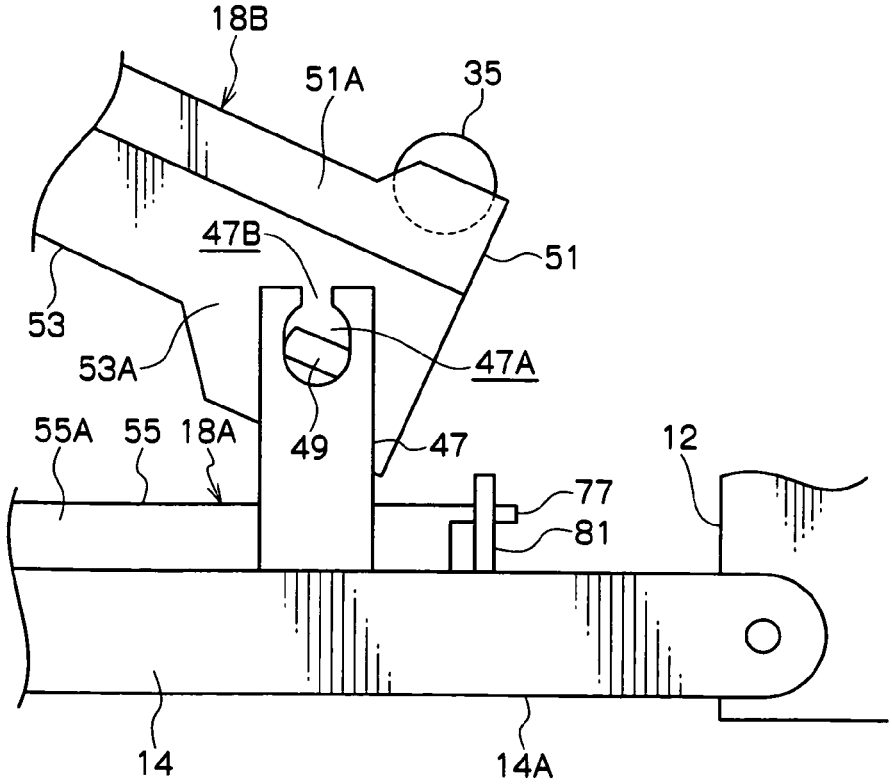

Bosses 49 are erected at the downstream side (lower side) in the reverse conveyance direction of the side plates 53A, 53B, respectively. Correspondingly, as shown in FIG. 2, supports 47 for rotatably supporting the bosses 49 are erected at the lower side of the front cover 14A of the cover body 14, respectively. As shown in FIGS. 13A and 13B, each of these supports 47 is a plate member having an elongated hole 47A into which the boss 49 is rotatably inserted and a slit 47B having a width narrower than the elongated hole 47A and extending from the elongated hole 47A toward an distal end thereof.

Here, the sectional shape of the boss 49 is an elongated shape formed of a pair of arc-shaped portions symmetric with respect to an axial center and a pair of straight portions symmetric with respect to the axial center. The radius of the pair of arc-shaped portions of the boss 49 is slightly smaller than the radius of the arc-shaped portion of the elongated hole 47A of the support 47. Therefore, the boss 49 can be slightly displaced in the radial direction in a state where the boss 49 abuts on the arc-shaped portion of the elongated hole 47A. Further, the thickness of the boss 49 is smaller than the clearance of the slit 47*b* of the support 47. For this reason, when the boss 49 is directed so as to be long in a longitudinal direction (in the longitudinal direction), the boss 49 can pass through the slit 47B and when the boss 49 is directed so as to be long in a lateral direction (in the lateral direction), the boss 49 cannot pass through the slit 47B.

Moreover, the boss 49 is positioned in the peripheral direction such that the pair of arc-shaped portions of the boss 49 are lined in the longitudinal direction of the side plate 53A (a vertical direction in FIG. 13A) and that the pair of straight portions of the boss 49 are lined in the width direction of the side plate 53A (left and right direction in FIG. 13A). Therefore, the boss 49 can be set in the support 47 in a state where the cover body 14 is opened and the second case part 53 is set in a vertical direction.

As shown in FIG. 4 to FIG. 6, the side plates 53A, 53B have positioning members 63, 65 each of which has substantially U shape which is opened to the third case part 55, respectively.

The third case part 55 is constructed of: a side plate 55A having a pin 67 with which the positioning member 63 is engaged; a side plate 55B having a pin 69 with which the positioning member 65 is engaged; and a guide plate 55C opposing to the guide plate 53D and having gently curved form. The guide plate 55C has plural ribs 55D arranged (lined) in a direction orthogonal to the reverse conveyance direction and extended along the reverse conveyance direction. The side plates 55A, 55B rotatably support two driving rollers 92B arranged in the reverse conveyance direction via axle bearings (not shown). These two driving rollers 92B are opposing to the driven rollers 92A, respectively, and construct a pair of conveyance rollers with the driven rollers 92A. The side plate 55A is mounted with a driving unit 73 including a motor and a gear train for driving the driving rollers 92B.

Figure 14:
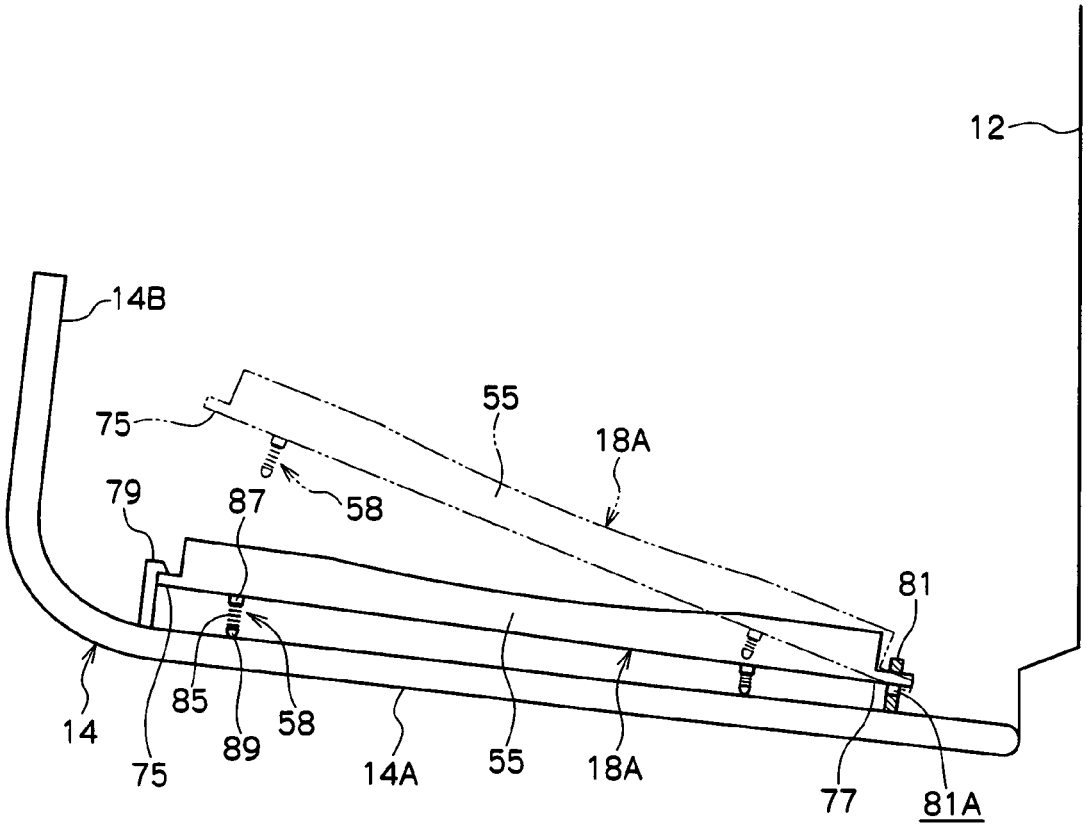
FIG. 14 is a side view showing an operation of mounting the conveyance unit in FIG. 4 to the cover body.

As shown in FIG. 6 and FIG. 14, engaging members 75, 77 are formed on end portions in the upstream side and downstream side in the reverse conveyance direction of the guide plate 55C, respectively. Correspondingly, the cover body 14 has engaged members 79, 81 with which the engaging members 75, 77 are engaged respectively. The engaging member 75 and the engaged member 79 are formed on the upper side of the guide plate 55C and on the upper side of the front cover 14A, respectively. The engaging member 77 and the engaged member 81 are formed on the lower side of the guide plate 55C and on the lower side of the front cover 14A, respectively.

The engaging member 77 is a plate-shaped member extending from the downstream end in the reverse conveyance direction (bottom end) of the guide plate 55C to the downstream side in the reverse conveyance direction (downward). The engaged member 81 is a plate member erected on the lower side of the front cover 14A of the cover body 14 and having a slit 81A into which the engaging member 77 is inserted. The engaging member 75 is a plate-shaped member formed on the upstream end in the reverse conveyance direction (top end) of the guide plate 55C and the engaged member 79 is a claw member erected on the upper side of the front cover 14A of the cover body 14.

Four urging mechanisms 58 are provided on the back side of the guide member in which the ribs 55D of the guide plate 55C are formed. Each of the urging mechanisms 58 is constructed of a compression coil spring 85, a support 87 for supporting the compression coil spring 85 on the back side of the guide plate 55C, and an abutting member 89 provided at a distal end of the coil spring 85. The urging mechanisms 58 are arranged at predetermined intervals at the upper, lower, left, and right positions on the back side of the guide plate 55C.

Here, the third case part 55 can slid by slight amount to the downstream (lower) side in the reverse conveyance direction in a state where the engaging member 75 is engaged with the engaged member 79 and where the engaging member 77 is engaged with the engaged member 81. The engaging member 75 is disengaged from the engaged member 79 by sliding the third case part 55 downward. Then, the third case part 55 is rotated upward around the engaging member 77 due to the urging force of the urging mechanism 58. By further rotating the third case part 55 upward, the engaging member 77 can be withdrawn from the slit 81A of the engaged member 81, and the first unit 18A can be dismounted from the cover body 14. On the other hand, when the first unit 18A is mounted on the cover body 14, firstly, the engaging member 77 is inserted deeply into the slit 81A. Next, the first unit 18A is rotated downward around the engaging member 77. Then, the urging mechanism 58 abuts to the cover body 14 and the first unit 18A is further rotated downward against the urging force of the urging mechanism 58. Then, the first unit 18A is slid to the upper side of the cover body 14, thereby the engaging member 75 is engaged with the engaged member 79 and the first unit 18A is rested on the cover body 14. At this time, the first unit 18A is not yet fixed to the cover body 14 and can be moved slightly in all directions.

Here, as shown in FIG. 13A, the bosses 49 formed on the lower side of the second case part 53 can be fitted in the supports 47 in a state where the second unit 18B is set in the vertical direction, and the bosses 49 can rotate in the elongated holes 47A. When the second unit 18B is rotated downward around the bosses 49, a pair of locking mechanisms (see FIG. 15) acts thereto, and the second unit 18A is fixed to the cover body 14.

Hereinafter, these locking mechanisms 100 will be described. Here, the pair of locking mechanisms 100 are laterally symmetric, and the locking mechanism 100 provided on the side plate 53A side of the second case part 53 will be described.

Figure 15:
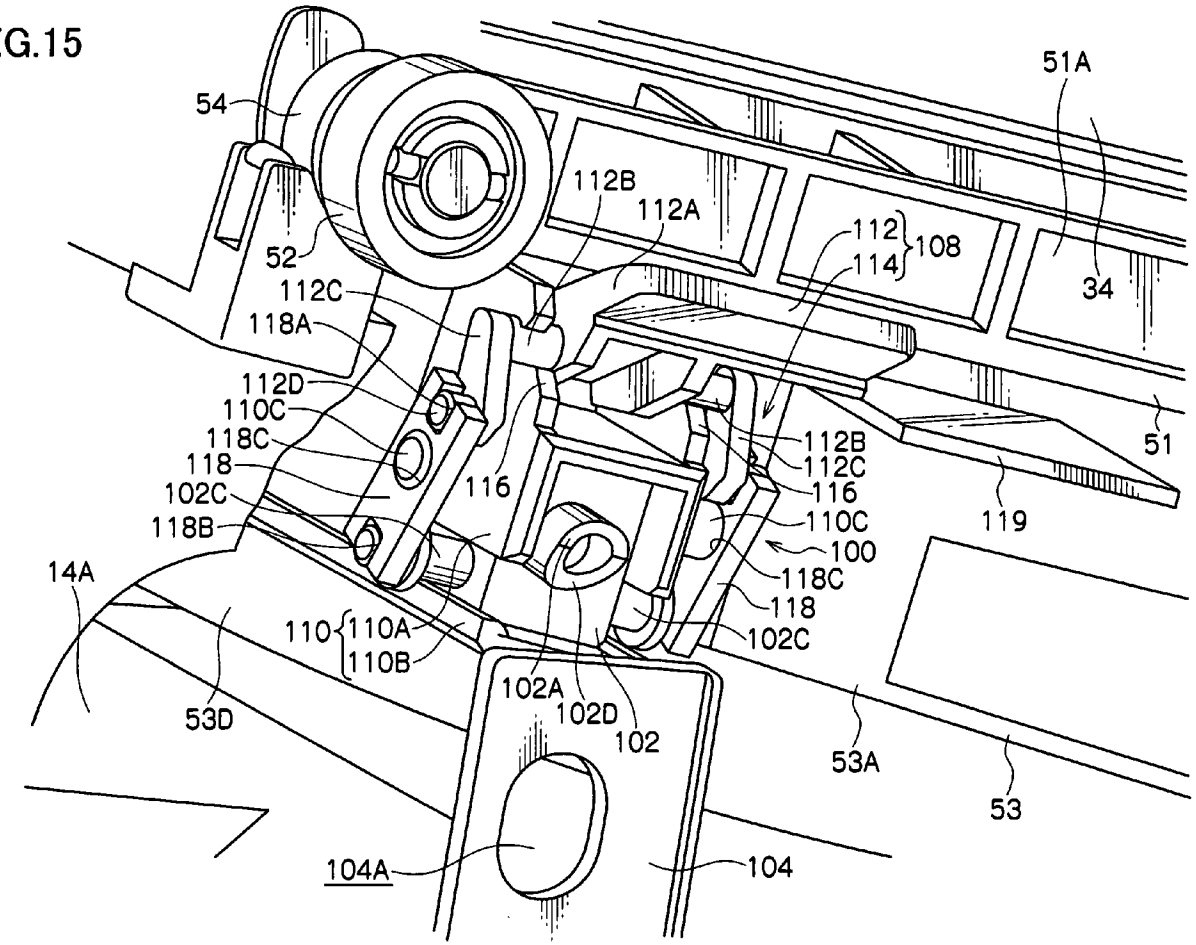
FIG. 15 is an enlarged perspective view of a portion of the conveyance unit in FIG. 4.
Figure 16:
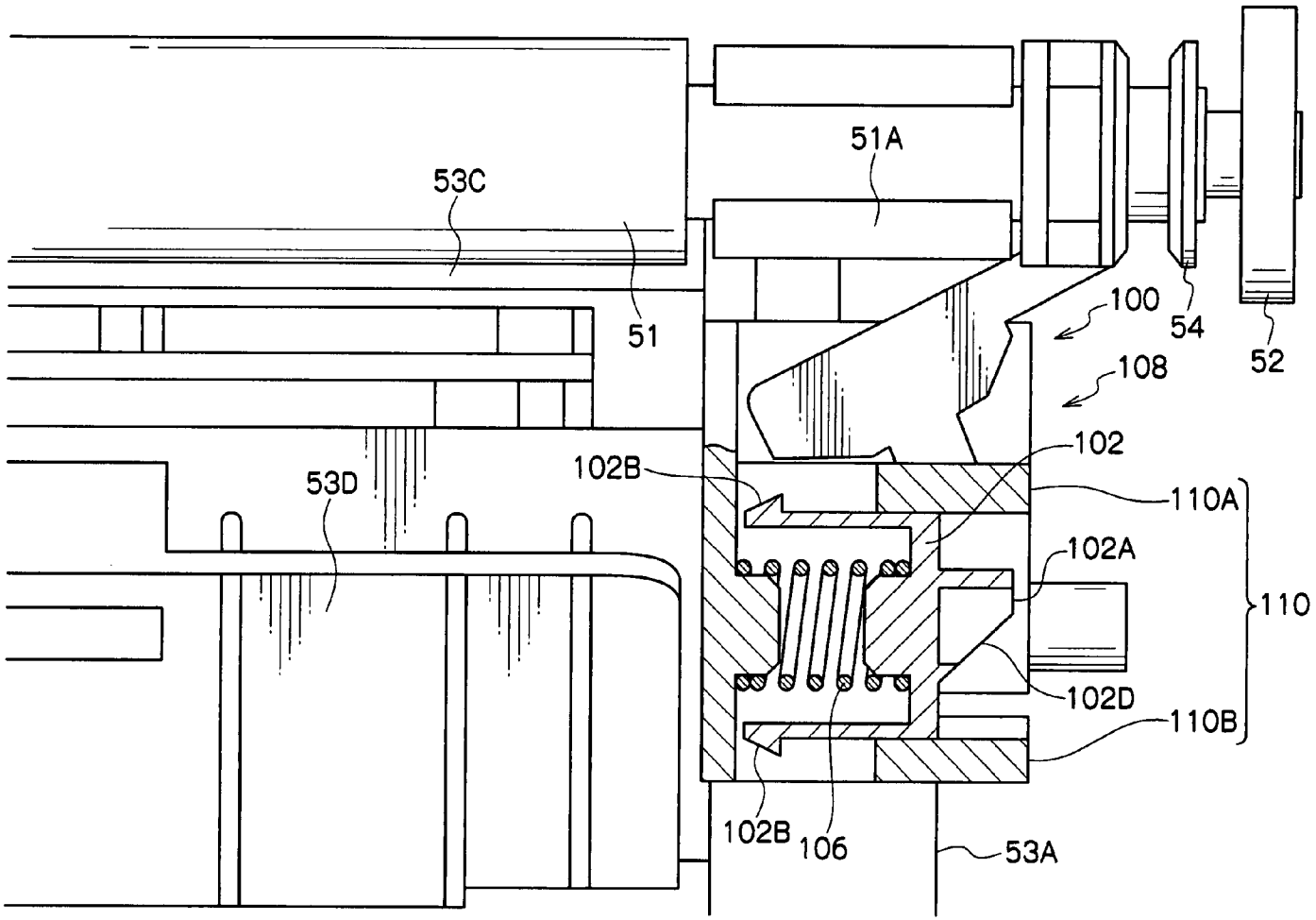
FIG. 16 is an enlarged sectional view of a portion of the conveyance unit in FIG. 4.
Figure 17:
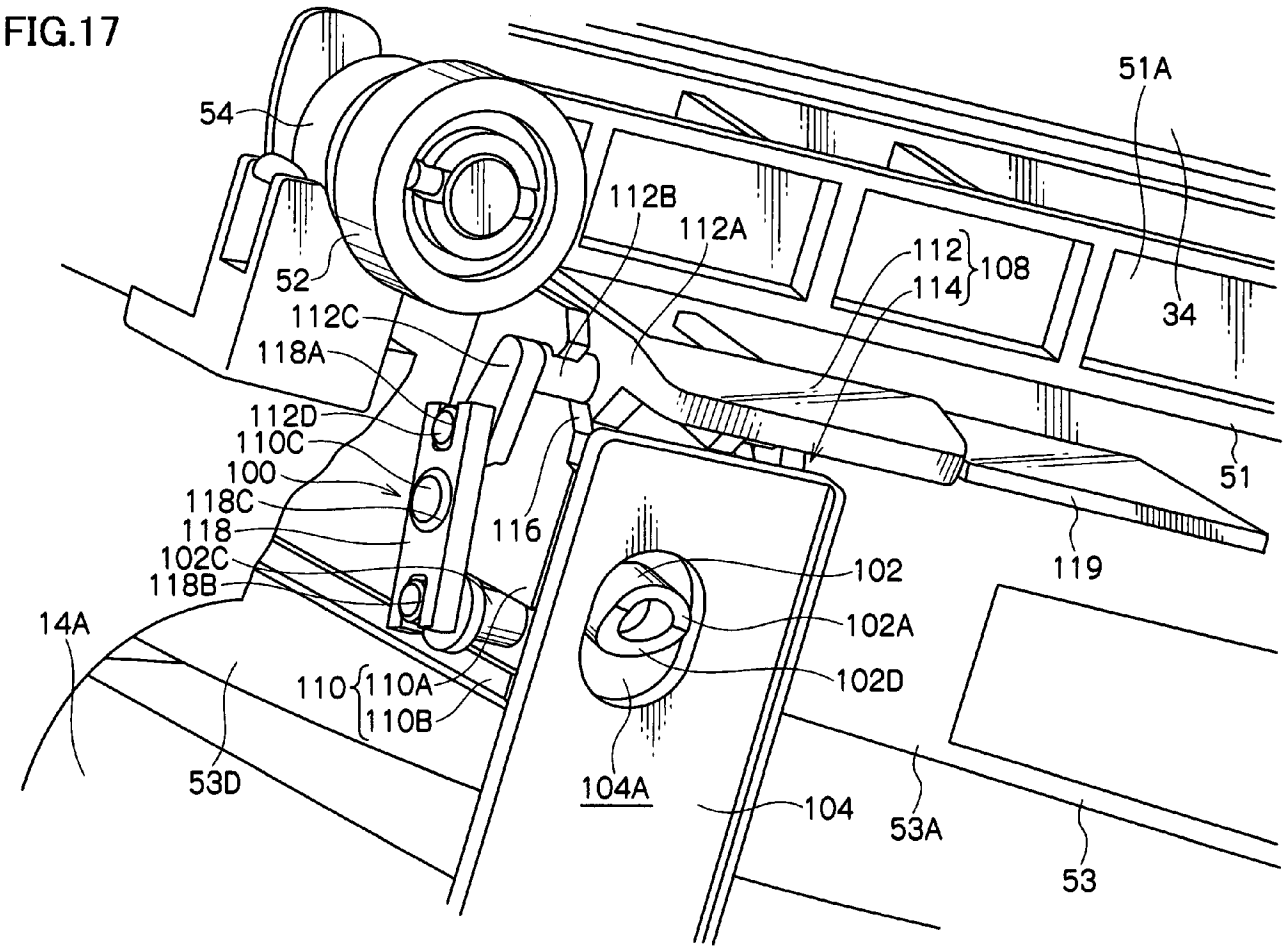
FIG. 17 is an enlarged perspective view of a portion of the conveyance unit in FIG. 4.

As shown in FIG. 15 to FIG. 17, the locking mechanism 100 includes a locking shaft 102, an engaged member 104, a compression coil spring 106, and an unlocking mechanism 108. The locking shaft 102 is provided on the upstream side in the reverse conveyance direction of the side plate 53A (near the driving roller 30) so as to be able slide in a direction orthogonal to the reverse conveyance direction (hereinafter referred to as "width direction"). The engaged member 104 is provided on the upper side of the front cover 14A of the cover body 14 and can be engaged with the locking shaft 102. The compression coil spring 106 urges the locking shaft 102 outward in the width direction. The unlocking mechanism 108 disengages the locking shaft 102 from the engaged member 104.

The locking shaft 102 is a rectangular cylindrical shaft and has a cylindrical locking portion 102A formed at one end in the axial direction. The locking shaft 102 is arranged such that this locking portion 102A is located outside in the width direction. The side plate 53A has a rail 110 for supporting the locking shaft 102 so as to be able slide in the width direction. The rail 110 is divided into a first rail part 110A formed in the plate 53C side and having substantially U shape, and a second rail part 110B formed in the plate 53D side and having substantially U shape.

A pair of locking claws 102B which can be engaged with the first rail part 110A and the second rail part 110B are formed on the other end in the axial direction of the locking shaft 102. Here, the locking shaft 102 is urged outward in the width direction (in the axial direction of the driving roller 30) by the compression coil spring 106. The locking shaft 102 is stopped from sliding outward in the width direction by the pair of locking claws 102 engaged with the first rail part 110A and the second rail part 110B. The guide part 53D side of the locking portion 102A is formed as a cam portion 102D tapered to have inclined surface.

Correspondingly, the engaged member 104 is a plate member having an elongated hole 104A into which the locking portion 102A can be inserted, and is erected outside in the width direction of the second case part 53 from the front cover 14A of the cover body 14. When the second unit 18B is rotated to a lower predetermined position around the boss 49, the cam part 102D abuts to the engaged member 104 and push the locking shaft 102 inside in the width direction against the urging force of the compression coil spring 106. Further, when the first unit 18A is rotated to a lower predetermined position, the locking portion 102A is opposed to the elongated hole 104A and is slid outward in the width direction by the urging force of the compression coil spring 106 and is inserted into the elongated hole 104A.

Figure 18:
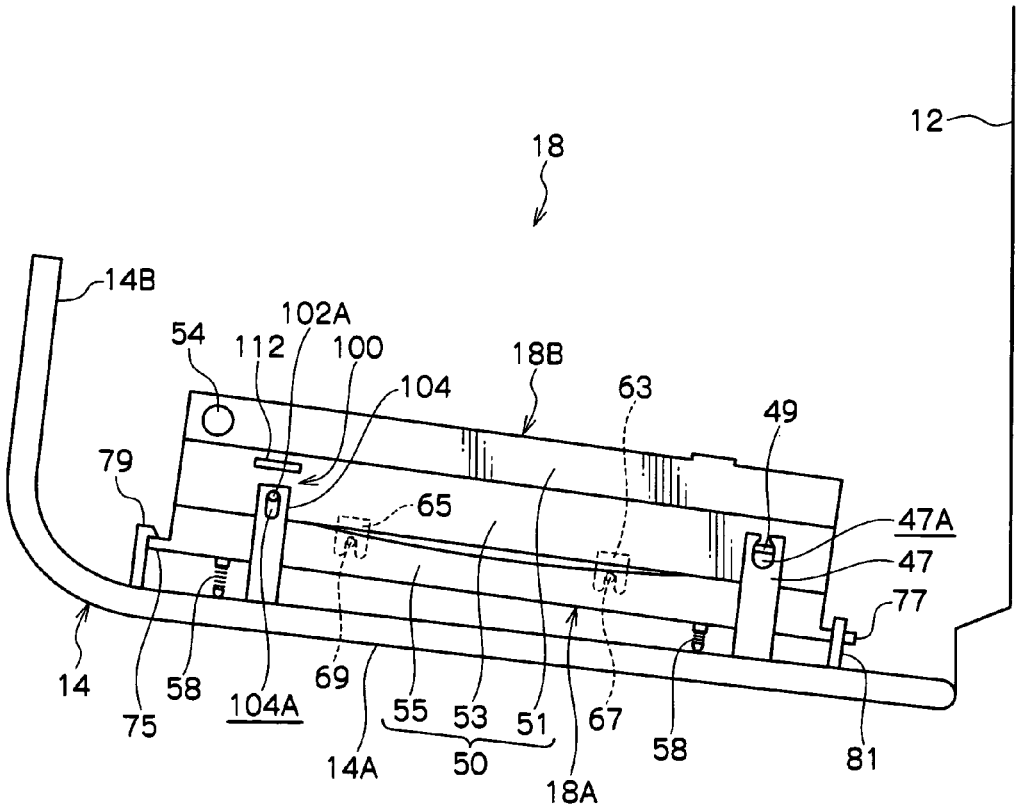
FIG. 18 is a side view showing a state where the conveyance unit in FIG. 4 is mounted to the opened cover body.

As shown in FIG. 18, in this state, the first unit 18A is urged toward the second unit 18B side by the urging mechanisms 58 and the positioning member 63 provided on the side plate 53A and having substantially U shape is engaged with the pin 67 provided on the side plate 55A of the third case part 55. Further, the positioning member 65 provided on the side plate 53B and having substantially U shape is engaged with the pin 69 provided on the side plate 55B of the third case part 55. Thus, the first unit 18A is positioned with respect to the second unit 18B.

The diameter of the locking portion 102A is slightly smaller than the diameter of the arc-shaped portion of the elongated hole 104A and the locking portion 102A can be displaced slightly in all directions in a state where the locking portion 102A abuts to the arc-shaped portion of the elongated hole 104A.

Further, as shown in FIG. 15 to FIG. 17, the unlocking mechanism 108 includes an operating lever 112 rotatably provided to the side plate 53A, and a link mechanism 114 for coupling the operating lever 112 to the locking shaft 102. The operating lever 112 has a grip part 112A having a rectangular plate shape, and a rotary shaft 112B provided to one end in the direction of the width of the grip part 112A and extended in the direction of the length of the grip part 112A.

A mounting part 116 having a rotary shaft 112B rotatably mounted thereto is provided between the first rail part 110A of the side plate 53A and the flat plate 53C. This mounting part 116 holds the rotary shaft 112B such that the axial direction of the rotary shaft 112B is substantially parallel to the adsorbing conveyance plane of the transfer belt 34. Therefore, the grip part 112A can be moved in a direction of a normal line of the adsorbing conveyance plane (a direction perpendicular to the adsorbing conveyance plane) of the transfer belt 34.

The link mechanism 114 includes: a pair of first link members 112C formed integrally with one end and the other end in the axial direction of the rotary shaft 112B, respectively; a pair of shafts 112D formed integrally with the respective first link members 112C; a pair of shafts 102C formed on the locking shaft 102; and a pair of second link members 118 for coupling the shafts 112D to the shafts 102C, respectively.

Each of the first link members 112C is a slender plate which has the rotary shaft 112B formed integrally at one end in a direction of length thereof and the shaft 112D formed integrally at the other end in the direction of length thereof. The shaft 112D is provided on the back side of the surface on which the rotary shaft 112B is provided.

The shafts 102C are formed integrally on a pair of wall surfaces which are opposing to each other in the reverse conveyance direction of the locking shaft 102, respectively. These shafts 102C are provided so as to face a clearance between the first rail part 110A and the second rail part 110B.

Each of the second link members 118 is a slender plate and has a circular hole 118C formed in the center in the direction of length thereof and has cutout portions 118A, 118B each formed at one end and the other end in the direction of length and having substantially U shape, respectively. Rotary shafts 110C provided on a pair of wall surfaces which are opposing to each other in the reverse conveyance direction of the first rail part 110A are rotatably fitted in the circular holes 118C. The shafts 112D are slidably fitted in the cutout portions 118A and the shafts 102C are slidably fitted in the cutout portions 118B. The normal direction of the rotary shaft 112B, the shaft 112D, the shaft 102C, and the first link member 112C are substantially parallel to the normal direction of the second link member 118 and a rotating action of the operating lever 112 is converted to a sliding action of the locking shaft 102. As shown in FIG. 15, when the operating lever 112 is rotated toward the conveyance belt 34 side, the locking shaft 102 is pressed inside the side plate 53A against the urging force of the compression coil spring 106 and the locking portion 102A is withdrawn from the elongated hole 104A. As shown in FIG. 17, when the gripping of the grip part 112A by an operator is released, the operating lever 112 rotates toward the cover body 14 and the locking shaft 102 is pushed outside the side plate 53A due to the urging force of the compression coil spring 106, whereby the locking portion 102A is inserted into the elongated hole 104A.

Next, the operation of the image forming apparatus 10 constructed in above-mentioned manner will be described. Firstly, recording paper P is picked up one by one from inside the paper feed cassette 46 by the pair of paper feed rollers 48 and is fed onto the conveyance belt 34 at predetermined timing by the pair of registration rollers 45. The recording paper P fed to the conveyance belt 34 is adsorbed electrostatically by the conveyance belt 34 and is conveyed to the image holding members 20Y to 20K of the respective colors.

On the other hand, in each of the developing units 16, firstly, the surface (peripheral surface) of the image holding member 20 is uniformly charged by the charging roller 22. Then, the surface (peripheral surface) of the image holding member 20 is scanned with a laser light (image light) from the optical box 24, whereby an electrostatic latent image based on the image date is formed on the surface of the image holding member 20. Thereafter, toner is transferred onto the image holding member 20 by the developing roller 26 to form a visible image on the surface of the image holding member 20.

When the visible image is formed on the surface of the image holding member 20 in this manner, a toner image (not-yet-fixed image) on the surface of the image holding member 20 is transferred to the recording paper P, which is adsorbed and passed by the conveyance belt 34, by the image holding member 20 and the transfer roller 36. This process is performed in order of yellow (Y), magenta (M), cyan (C), and black (K) to transfer the toner image (not-yet-fixed image) of full color to the recording paper P and then the recording paper P is conveyed to the fixing unit 38 by the conveyance belt 34.

The recording paper P conveyed to the fixing unit 38 having a toner image, which is transferred to the recording paper P and is not yet fixed thereon, is heated and pressed by the heating roller 40 and the pressing roller 42, thereby the toner image is fixed. Then, the recording paper P having a toner image fixed by the fixing unit 38 is discharged to the paper discharge tray 44. The surfaces of the image holding members 20 are cleaned by the cleaning units after transferring of the toner image to the recording paper P is finished in order to be prepared for the next image forming processing.

Figure 19:
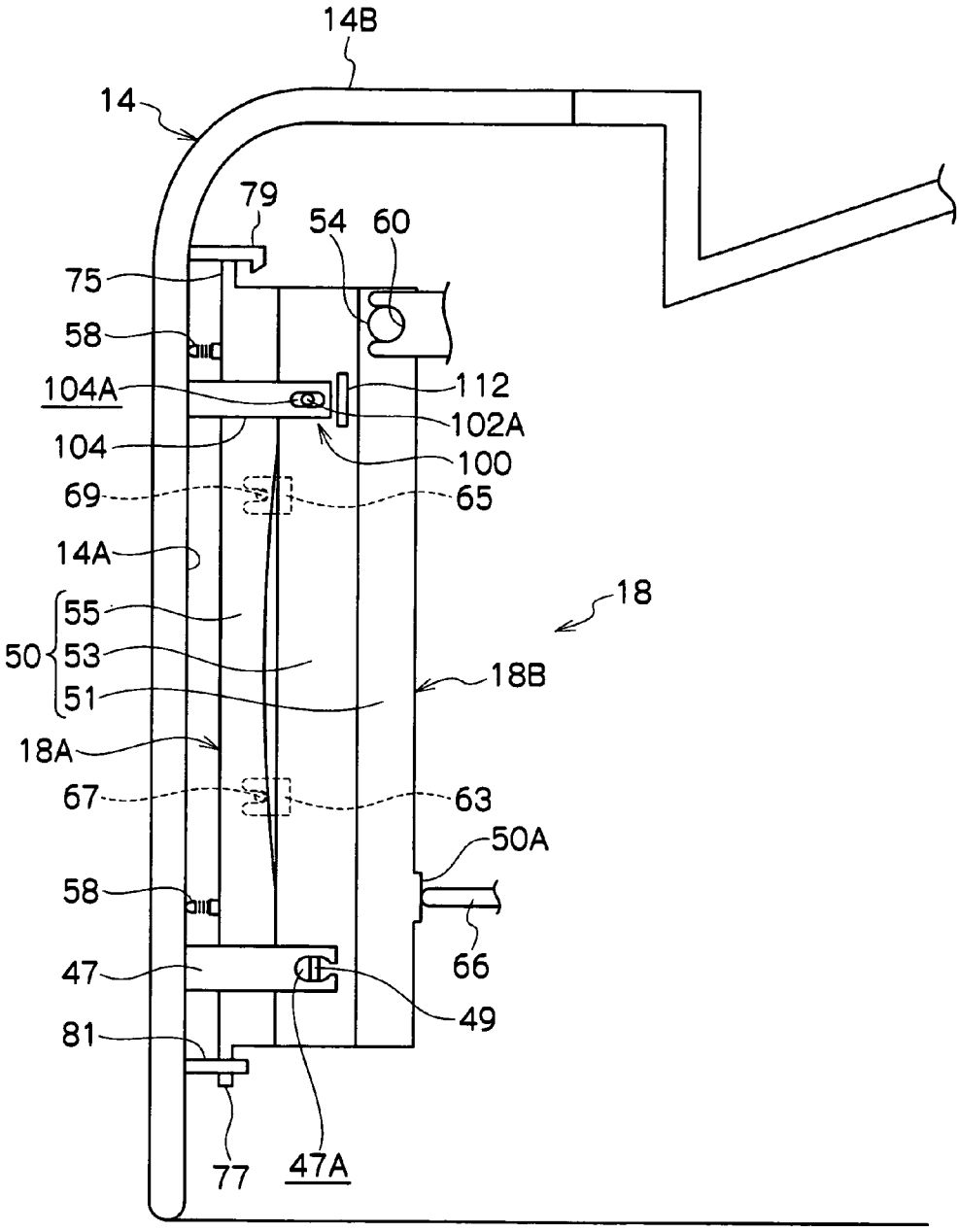
FIG. 19 is a side view showing a state where the conveyance unit in FIG. 4 is mounted to the closed cover body.

Here, when the recording paper P is jammed or the developing units 16 are subjected to maintenance (e.g., are replenished with toner), as shown in FIG. 18, the cover body 14 is tilted down to open the developing units 16 (image holding members 20). Then, the transfer belt 34 is separated from the image holding members 20, so that the recording paper P jammed between the transfer belt 34 and the image holding members 20 can be removed. Moreover, since the fixing unit 38 is also opened at the same time, the recording paper P jammed in the fixing unit 38 can be also removed. Then, after the operation is finished, as shown in FIG. 19, the cover body 14 is rotated toward the main frame 12 to close the developing units 16 (image holding members 20).

At this time, as shown in FIG. 8, the annular members 54, 56, which are fitted with a clearance on the both ends of the rotary shaft 30A of the driving roller 30 which are projecting outward from the case 50, are made to abut to the concave portions 60 formed in the main frame 12 at a predetermined pressure due to the urging forces of the coil springs 58 which are abutting to the outer surface (cover body 14 side) of the case 50.

Further, as shown in FIG. 8 to FIG. 10, the projection 62 provided on one edge portion of the case 50 is inserted with a clearance into the slit portion 64 formed in the main frame 12, and the tip surface 66A of the support 66 having the slit portion 64 formed therein abuts to the engaging surface 50A of the case 50. Moreover, as shown in FIG. 11, the tip surface 66A of the support 66 abuts on the engaging surface 50B of the case 50. Thus, the positions of the conveyance belt 34 (transfer rollers 36) and the image holding members 20 can be regulated to predetermined positions.

Moreover, the plate spring 68 fitted to the main frame 12 presses the outer side surface of the projection 62. With this configuration, the conveyance unit 18 is urged toward one end side in the direction of the width of the conveyance belt 34 (toward one end side in the axial direction of the driving roller 30 and the driven roller 32). In other words, the conveyance unit 18 has its movement regulated not only in the radial direction of the driving roller 30 (the direction orthogonal to the axial direction) but also in the axial direction of the driving roller 30 and the driven roller 32.

Therefore, even if, for example, something collides with the cover body 14 and push the cover body 14 during printing, the conveyance belt 34 of the conveyance unit 18 provided in the cover body 14 can be prevented from being displaced in the main scanning direction (the above-mentioned axial direction) with respect to the developing units 16 (image holding members 20). Hence, color registration in the main scanning direction can be improved at the time of color printing. This is particularly effective when the recording paper P is thick.

Figure 20:
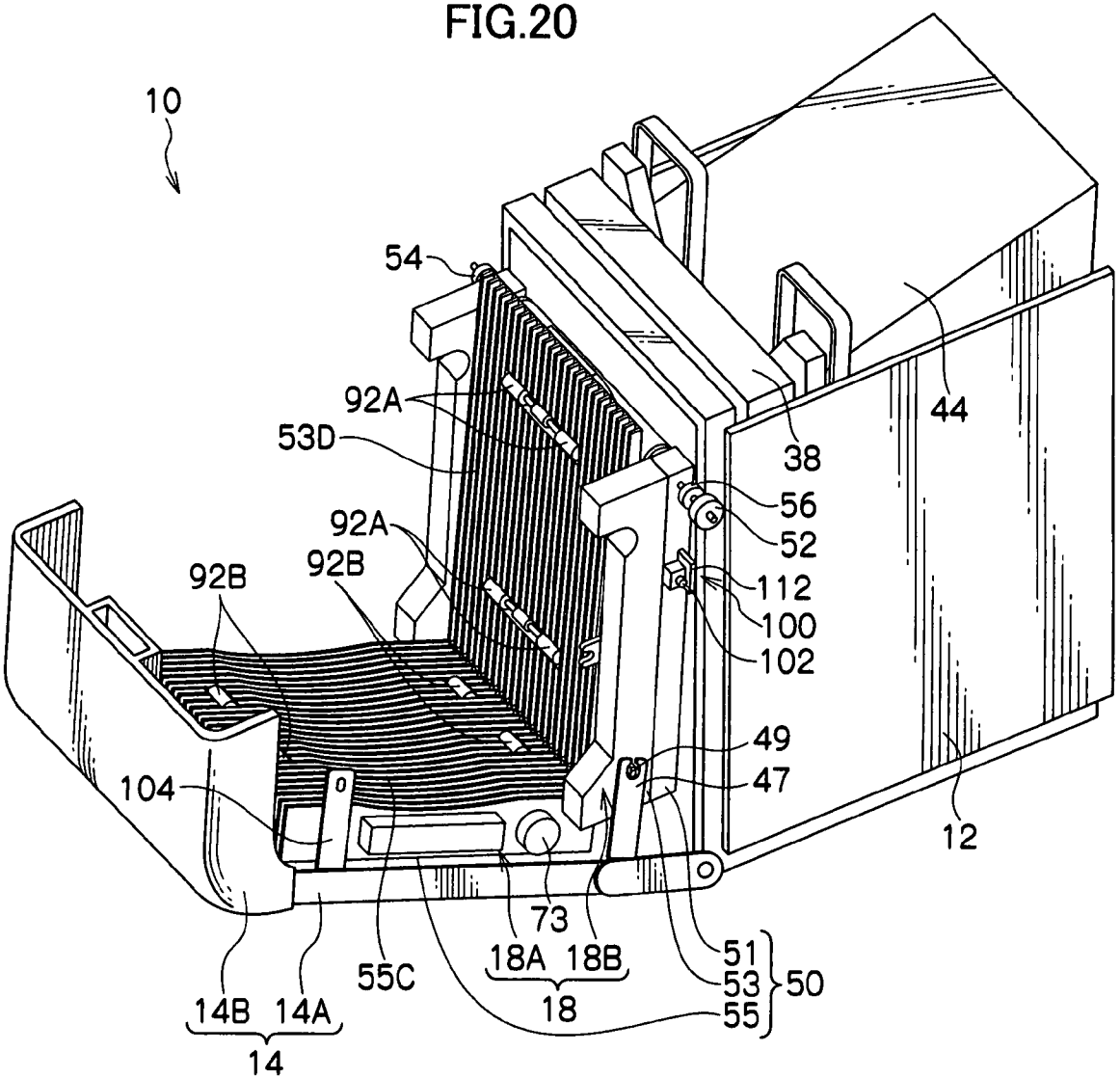
FIG. 20 is a perspective view showing the image forming apparatus in FIG. 1.

When the recording paper P is jammed in the double-sided conveyance unit 90, as shown in FIG. 15, the operating lever 112 can be lifted up (in the direction to dismount the second case part 53) to withdraw the locking portion 102A from the elongated hole 104A. Next, as shown in FIG. 20, the second unit 18B is rotated upward around the bosses 49 to separate the driven rollers 92A from the driving rollers 92B and thereby separate the guide plate 53D from the guide plate 55C. Thus, the recording paper P jammed in the double-sided conveyance unit 90 can be removed.

When the second unit 18B is to be dismounted from the cover body 14, as shown in FIG. 15, after the operating lever 112 is lifted up, as shown in FIG. 13B and FIG. 20, the second unit 18B is rotated upward around the bosses 49 (in a direction to depart from the cover body 14) to set the second unit 18B in a vertical direction (attitude) to withdraw the bosses 49 from the elongated hole 47A. Thus, the operation for dismounting the second unit 18B from the cover body 14 is finished.

When the second unit 18B is to be mounted to the cover body 14, as shown in FIG. 13A, firstly, the second unit 18B is set in vertical direction (attitude) and the bosses 49 are inserted into the elongated holes 47A. Next, as shown in FIG. 133B, the second unit 18B is rotated downward (in the direction to approach the cover body 14) around the bosses 49, thereby the second unit 18B is reclined in a lateral direction, as shown in FIG. 18, to cause the locking part 102A engaged with the elongated hole 104A, whereby the second unit 18B is rested on the cover body 14. This operation can be more easily performed than an operation of mounting the second unit 18B by moving the second unit 18B straightly toward the cover body 14.

Here, the cover body 14 has substantially L shaped form when viewed from the side, and the top cover 14B rises up from the top end of the front cover 14A to the main frame side. For this configuration, it is impossible to mount the second unit 18B by sliding the second unit 18B toward the bottom side of the cover body 14 because the top cover 14B blocks a path for mounting or dismounting the second unit 18B.

However, in this exemplary embodiment, the second unit 18B is mounted to or dismounted from the front cover 14A by moving the second unit 18B in vertical directions between the top cover 14B and the main frame 12. Hence, the top cover 14B does not become an obstacle.

Figure 21:
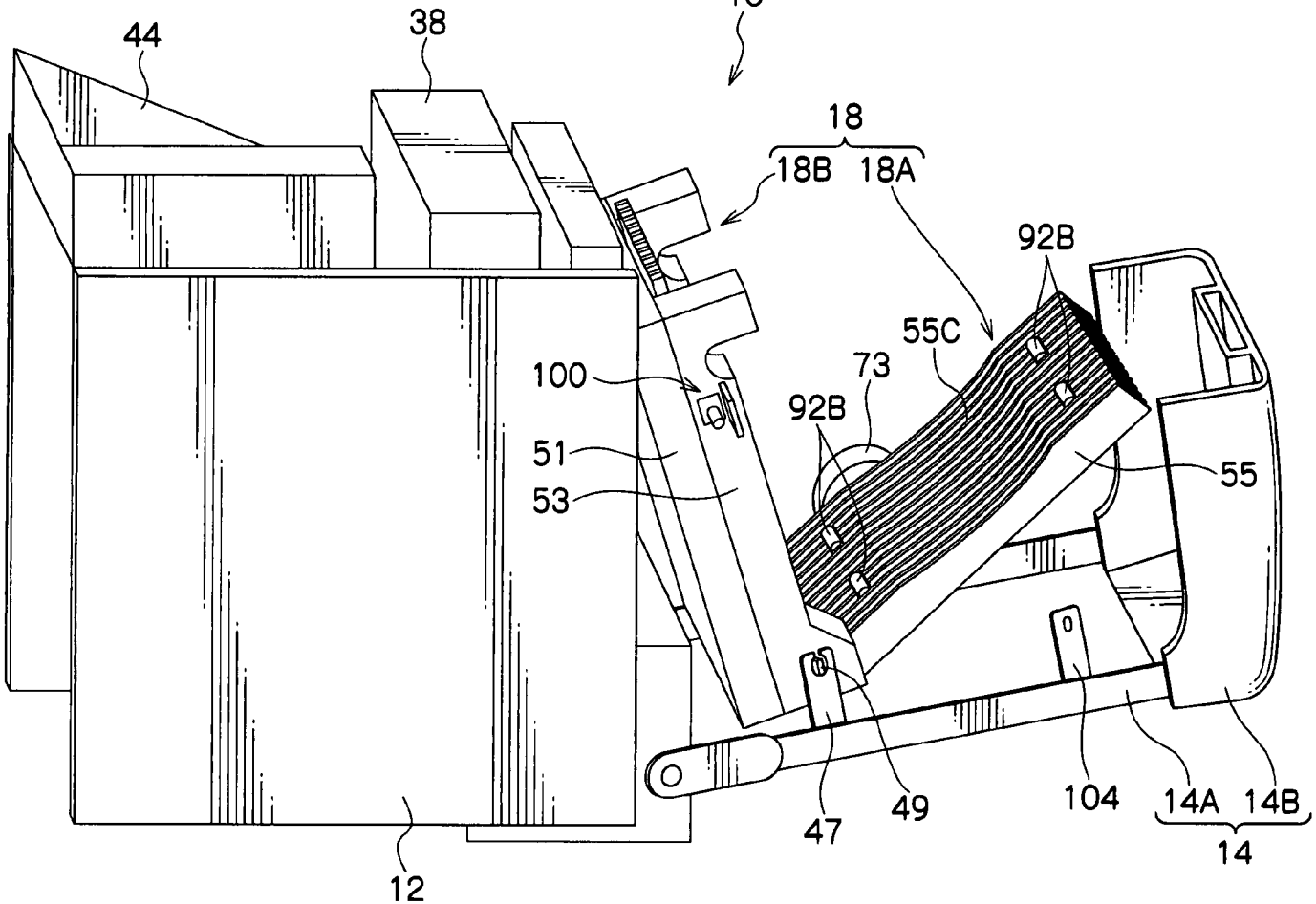
FIG. 21 is a perspective view showing the image forming apparatus in FIG. 1.

On the other hand, when the first unit 18A is to be dismounted from the cover body 14, firstly, the first unit 18A is slid slightly toward the main frame 12 to disengage the engaging member 75 from the engaged member 79. Then, as shown in FIG. 21, the first unit 18A is rotated upward around the engaging member 77 (in a direction to depart from the cover body 14) to disengage the engaging member 77 from the engaged member 81. Thus, the operation of dismounting the first unit 18A from the cover body 14 is finished.

When the first unit 18A is to be mounted to the cover body 14, firstly, the engaging member 77 is inserted deeply into the engaged member 81. Next, the first unit 18A is rotated downward (in a direction to approach the cover body 14) around the engaging member 77, thereby the first unit 18A is reclined in the lateral direction. Then, as shown in FIG. 14, the first unit 18A is slid toward the top cover 14B to engage the engaging member 77 with the engaged member 79. This operation can be performed more easily than the operation of mounting the first unit 18A by moving the first unit 18A straightly with respect to the cover body 14.

Here, as same as the second unit 18B, the first unit 18A is being mounted to or dismounted from the front cover 14A by moving the first unit 18A in a vertical direction between the top cover 14B and the main frame 12. Hence, the top cover 14B does not become an obstacle.

Further, since the driving unit 83 projects toward one end side in the direction of the width of the first unit 18A, in a construction such that the first unit 18A being mounted or dismounted by sliding the first unit 18A toward the lower side of the front cover 14A, a path for mounting or dismounting the driving unit 73 in the front cover 14A becomes a dead space in which any part cannot be arranged. For this reason, to reduce the dead space in the front cover 14A, the path for mounting or dismounting the driving unit 73 needs to be shortened, and thereby the arrangement of the driving unit 73 is limited.

However, in this exemplary embodiment, the first unit 18A having the driving unit 73 is being mounted to or dismounted from the front cover 14A by moving it in a vertical direction. Hence, this eliminates the need for providing a path for mounting and dismounting the driving unit 73. Therefore, it is possible to reduce a dead space above the front cover 14A and to enhance the flexibility of arrangement of the driving unit 73.

Moreover, in this exemplary embodiment, when the cover body 14 is tilted down, the conveyance unit 18 mounted to the cover body 14 and the fixing unit 38 housed in the main frame 12 are opened at the same time. For this reason, the conveyance unit 18 mounted to the cover body 14 and the fixing unit 38 can be maintained and exchanged at the same time. Moreover, this can eliminate the need for providing a dedicated cover body for opening and closing the fixing unit 38.

Next, the second exemplary embodiment of the present invention will be described. Here, the same constructions as the first exemplary embodiment are denoted by the same reference signs and descriptions thereof will be omitted.

Figure 22:
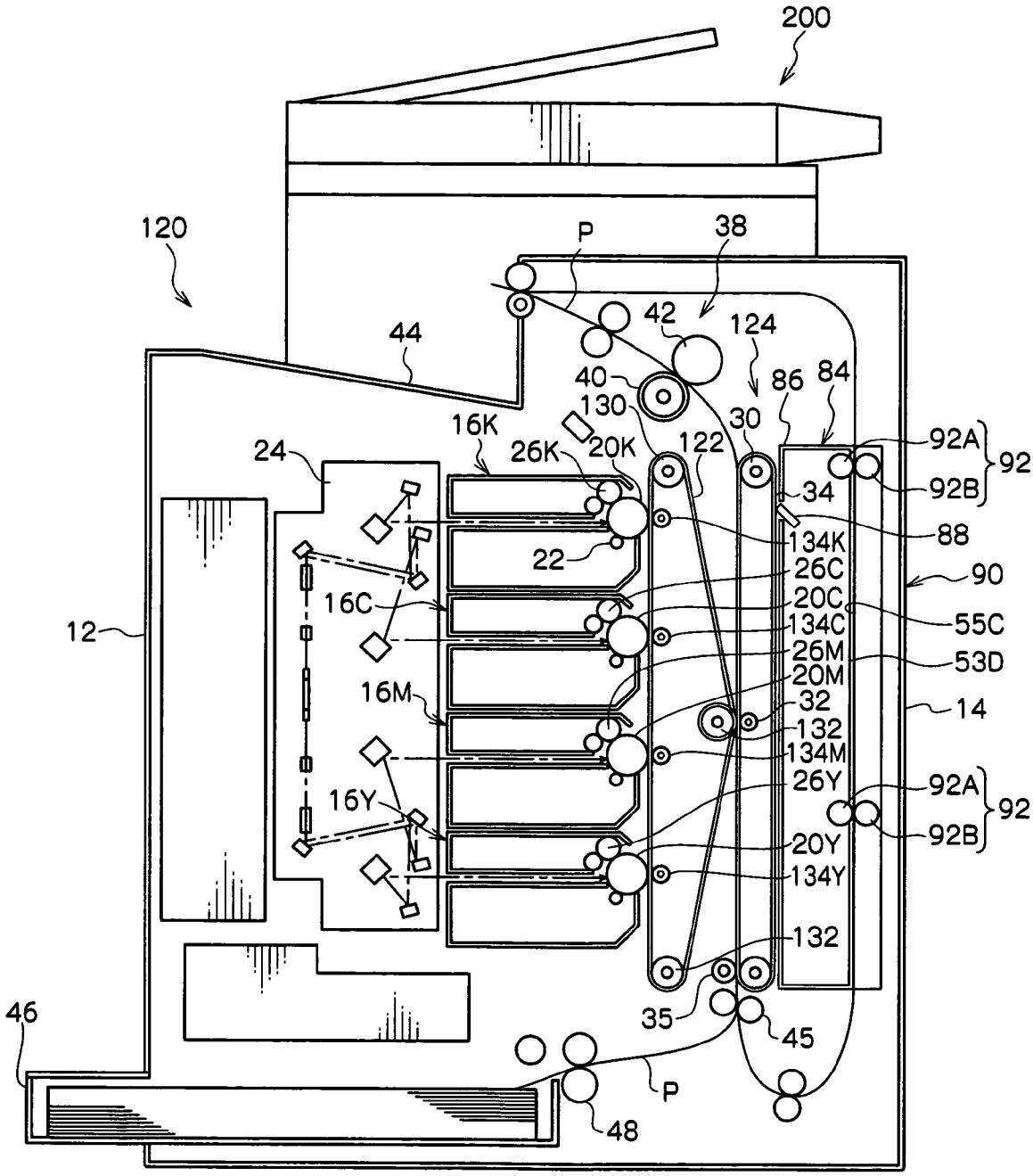
FIG. 22 is a schematic side view showing a construction of an image forming apparatus of a second exemplary embodiment.
Figure 23:
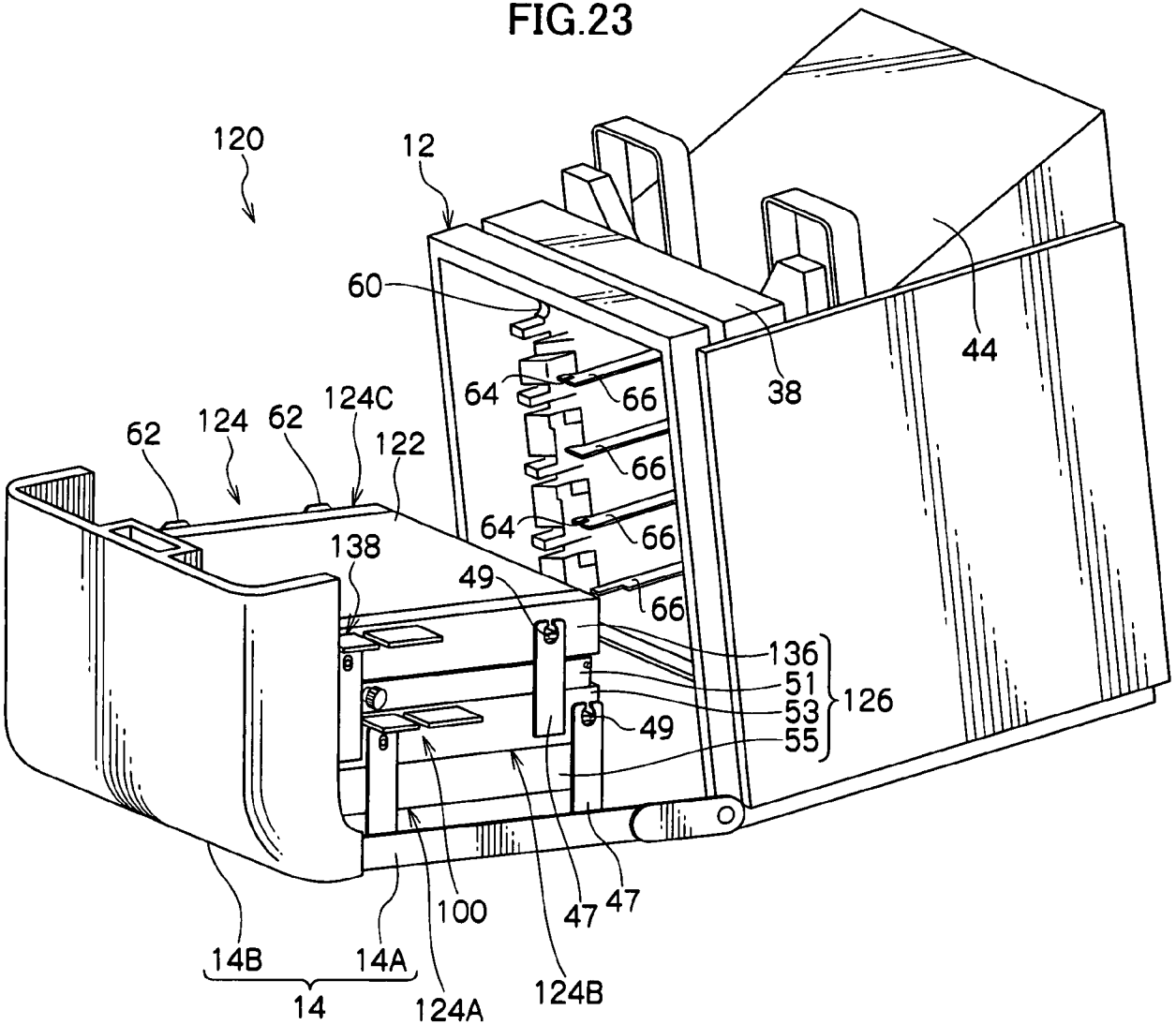
FIG. 23 is a perspective view showing the image forming apparatus in FIG. 22.

As shown in FIG. 22 and FIG. 23, in an image forming apparatus 120 of this exemplary embodiment, a conveyance unit 124 having not only the conveyance belt 34 but also an intermediate transfer belt 122 can be mounted to or dismounted from the cover body 14. This conveyance unit 124 includes a first unit 124A having the driving rollers 92B and the like, a second unit 124B having the conveyance belt 34 and the like, and a third unit 124C having the intermediate transfer belt 122 and the like.

A case 126 of the conveyance unit 124 is constructed of: a fourth case part 136 that rotatably supports a driving roller 130 and plural driven rollers 132, around which the intermediate transfer belt 122 is stretched, and transfer rollers 134Y, 134M, 134C, and 134K via axel bearings (not shown); the first case part 5 1; the second case part 53; and the third case part 55. The fourth case part 136 is locked to the second case part 53 by a locking mechanism 138 of the same construction as the locking mechanism 100. Moreover, the fourth case part 136 has the projections 62, engaging surfaces 50A and SOB (see FIG. 4) and is positioned with respect to the main frame 12 in a state where the cover body 14 is closed.

Here, also in this exemplary embodiment, as described above, the third unit 124C can be mounted to the front cover 14A by moving the third unit 124C in a vertical direction between the top cover 14B and the main frame 12. Hence, the top cover 14B does not become an obstacle.

Next, the third exemplary embodiment of the present invention will be described. Here, the same constructions as the first and second exemplary embodiments are denoted by the same reference signs and descriptions thereof will be omitted.

Figure 24:
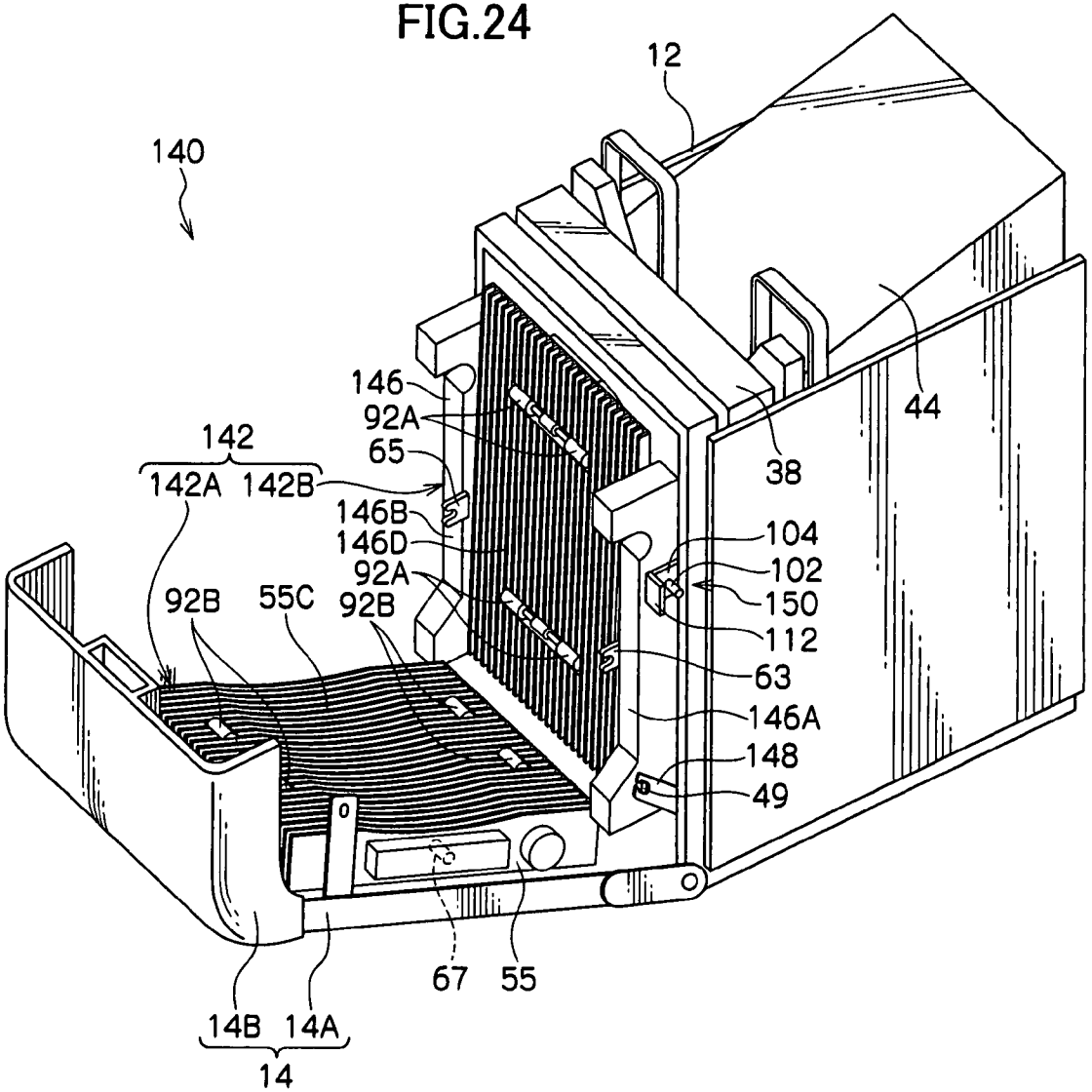
FIG. 24 is a perspective view showing an image forming apparatus of a third exemplary embodiment.
Figure 25:
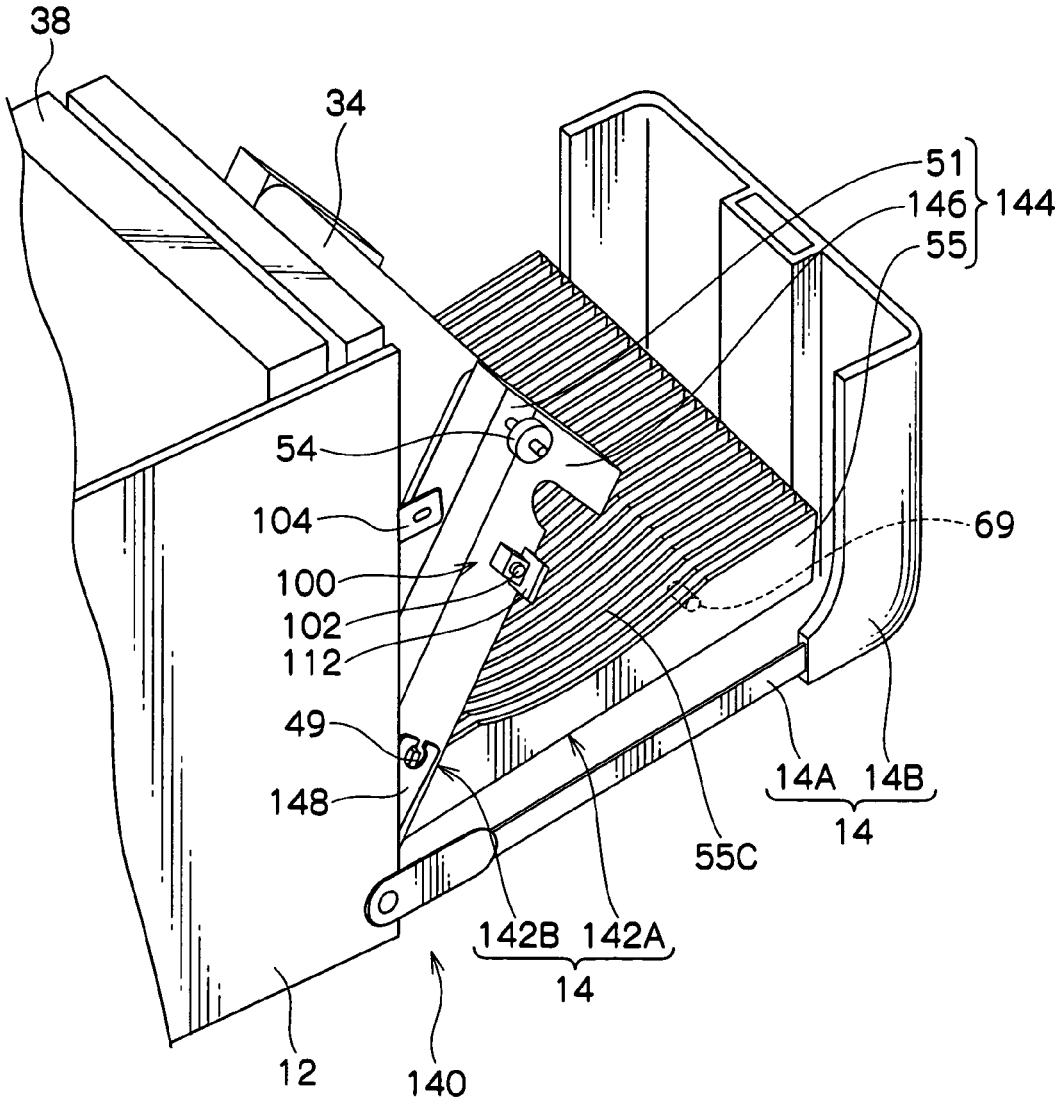
FIG. 25 is a perspective view showing the image forming apparatus in FIG. 24.

As shown in FIG. 24 and FIG. 25, in an image forming apparatus 140 of this exemplary embodiment, a conveyance unit 142 is constructed of a first unit 142A having the driving rollers 92B and the like and a second unit 142B having the conveyance belt 34 and the driven rollers 92A. The first unit 142A is constructed in the same manner as the first unit 18A of the first exemplary embodiment and can be mounted to or dismounted from the cover body 14. On the other hand, the second unit 142B is mounted to the main frame 12 so as to be able to tilt down.

A case 144 of the conveyance unit 142 is constructed of the first case part 51, the third case part 55, and a second case part 146 to which the first case part 51 is fastened by screws. The second case part 146 is constructed of: a pair of side plates 146A and 146B each having two screw fastening portions 59 opposing to screw fastening portions 57; a flat plate (not shown) of the same construction as the flat plate 53C of the first exemplary embodiment; and a guide plate 146D of the same construction as the guide plate 53D of the first exemplary embodiment.

The guide plate 146D has plural ribs (not shown) arranged in line toward the direction of width and extended along in the reverse conveyance direction. Moreover, driven rollers 92A are rotatably supported one to the upstream side and one to the downstream side in the reverse conveyance direction of the guide plate 146D.

The bosses 49 are erected at the side plates 146A and 146B in downstream sides (lower sides) thereof in the reverse conveyance direction. Correspondingly, supports 148 for rotatably supporting the bosses 49 are erected at the lower end corners of the front opening of the main frame 12. Each of these supports 148 is a plate member having an elongated hole into which the boss 49 is rotatably inserted and a slit which is narrower in width than the elongated hole and extends from the elongated hole toward a distal end thereof. Moreover, the supports 148 are fitted to the main frame 12 in such a way that the distal end side is located diagonally above a base end side.

Here, the radius of the pair of arc-shaped portions of the boss 49 is slightly smaller than the radius of a pair of arc-shaped portions of the elongated hole of the support 148, so that the boss 49 can be slightly displaced in the radial direction in a state where the boss 49 abuts to the arc-shaped portions of the elongated hole. Moreover, the thickness of the boss 49 is smaller than the clearance of the slit of the support 148. Hence, when the boss 49 is directed in a direction (in a diagonal direction) in which the boss 49 becomes long in a diagonal direction, the boss 49 can pass through the slit, and when the boss 49 is directed in a direction (in a lateral direction) in which the boss 49 becomes long in a lateral direction or in a direction (in a longitudinal direction) in which the boss 49 becomes long in a longitudinal direction, the boss 49 cannot pass through the slit.

The boss 49 is located in a peripheral direction such that the pair of arc-shaped portions of the boss 49 are arranged in the longitudinal direction of the side plate 53A and that the pair of straight portions of the boss 49 are arranged in the width direction of the side plate 53A. Thus, the bosses 49 can be set in the supports 148 in a state where the cover body 14 is opened and where the second case part 146 is set in a diagonal direction (attitude).

Moreover, the image forming apparatus 140 of this exemplary embodiment has a locking mechanism 150 for locking the second unit 142*b* to the main frame 12. This locking mechanism 150 has a construction such that the locking mechanism 100 of the first exemplary embodiment is turned by 180 degrees around the locking shaft 102. That is, the engaged member 104 with which the locking shaft 102 is engaged is formed on the top end corner of the front opening of the main frame 12. When the second unit 142B is rotated toward the main frame side around the bosses 49, the locking shaft 102 is engaged with the engaged member 104 and the second unit 142B is rested on the main frame 12. Then, when the cover body 14 is closed, the second unit 18B is urged toward the main frame 12 due to the urging mechanism 58 (see FIG. 4) and is positioned with respect to the main frame 12 by the positioning mechanisms such as the annular members 54 and 56. Moreover, the first unit 142A is urged toward the second unit 142B and is positioned with respect to the second unit 142B by the positioning mechanisms such as the U shaped positioning member 63 and the pin 67.

When the locking lever 112 is moved toward the outside of the main frame 12, the locking shaft 102 is disengaged from the engaged member 104, and the second unit 142B can be rotated downward around the bosses 49.

Here, the driven rollers 92A and the guide plate 146D are provided on the second unit 142B supported by the main frame 12, and the driving rollers 92B and the guide plate 55C are provided on the first unit 142A supported by the cover body 14. For this reason, when the cover body 14 is tilted down, the driven rollers 92A are separated from the driving rollers 92B and the guide plate 146*d* is separated from the guide plate 55C, respectively. Thus, the recording paper P nipped and jammed between the driven rollers 92A and the driving rollers 92B and between the guide plate 146*d* and the guide plate 55C can be removed.

Incidentally, in the first to third exemplary embodiments, the unit mounted to the cover body is described as the unit having the conveyance belt, the double-sided conveyance unit, and the intermediate transfer belt. However, a construction such that other unit such as including the developing unit can be mounted to the cover body.

The foregoing description of the exemplary embodiments of the present invention has been provided for the purpose of illustration and description. It is not intended to be exhaustive or to limit the invention to the precise form disclosed herein. Obviously, many modifications and variations will be apparent to a practitioner skilled in the art. The exemplary embodiments were chosen and described in order to best explain the principles of the invention and its practical applications, thereby enabling others skilled in the art to understand the invention according to various embodiments and with various modifications as are suited to the particular use contemplated. It is intended that the scope of the invention be defined by the following claims and their equivalents.

What is claimed is:

1. An image forming apparatus comprising:

an image holding member;

an image forming section that forms an image on the image holding member;

a main frame that houses at least the image holding member and the image forming section;

a cover body that is hingedly mounted to the main frame so as to be able to tilt down and includes a side cover for opening and closing a side surface of the main frame and a top cover for opening and closing a top surface of the main frame; and a unit that is mounted to and dismounted from the side cover by moving in a vertical direction between the top cover and the main frame in a state where the cover body is tilted down, wherein the unit is pivotally attached to the cover body at a distance from where the cover body is hingedly attached to the main frame.

2. The image forming apparatus of claim 1, further comprising:

a first engaging member that is provided at one end side of the unit or at one end side of the side cover;

a first engaged member that is provided at the one end side of the side cover or at the one end side of the unit and that the first engaging member can be engaged with and disengaged from;

a second engaging member that is provided at another end side of the unit or at another end side of the side cover; and a second engaged member that is provided at the other end side of the side cover or at the other end side of the unit and that the second engaging member can be rotatably engaged with and disengaged from.

3. The image forming apparatus of claim 1, wherein the unit comprises a conveyance unit that conveys a recording medium.

4. The image forming apparatus of claim 3, wherein the unit comprises a driving unit that drives the conveyance unit.

5. The image forming apparatus of claim 3, wherein the conveyance unit comprises:

a pair of conveyance rollers that nip and convey a recording medium having an image formed thereon; and a pair of guide members that are mutually opposite to each other, and feed the recording medium nipped and conveyed by the pair of conveyance rollers into the main frame.

6. The image forming apparatus of claim 5, wherein the unit comprises:

a first unit that has one of the pair of conveyance rollers and one of the pair of guide members; and a second unit that is arranged between the first unit and the main frame so as to be able to contact with and separate from the first unit and has another one of the pair of conveyance rollers and another one of the pair of guide members.

7. The image forming apparatus of claim 6, wherein the second unit comprises a transfer unit that is interposed between the other one of the pair of guide members and the image holding member and transfers an image formed on the image holding member to a recording medium.

8. The image forming apparatus of claim 1, further comprising:

a pair of conveyance rollers, one of which is provided on the unit and another of which is provided on the main frame and that nip and convey a recording medium having an image formed thereon; and a pair of guide members that are mutually opposite to each other, one of which is provided on the unit and another of which is provided on the main frame, and that feed the recording medium nipped and conveyed by the pair of conveyance rollers into the main frame.

9. The image forming apparatus of claim 1, wherein the unit comprises a transfer unit that transfers an image formed on the image holding member to a recording medium.

10. The image forming apparatus of claim 1, further comprising a fixing unit that is housed in the main frame so as to be opened and closed by the top cover and fixes an image, that is transferred to a recording medium from the image holding member, onto the recording medium.

11. The image forming apparatus of claim 2, wherein the second engaged member is disengaged from the second engaging member by moving the one end side of the unit away from the side cover.

12. The image forming apparatus of claim 2, wherein when the cover body is tilted down, the one end side is disposed closer to the main frame than the other end side.

13. The image forming apparatus of claim 2, wherein when the cover body is tilted down, the one end side is disposed farther from the main frame than the other end side.

14. The image forming apparatus according to claim 1, wherein the cover body is formed such that the side cover and the top cover are integrally formed.

15. The image forming apparatus according to claim 2, wherein the cover body is formed such that the side cover and the top cover are integrally formed.

* * * * *